US009247370B2

(12) United States Patent
Mizuno et al.

(10) Patent No.: US 9,247,370 B2
(45) Date of Patent: Jan. 26, 2016

(54) SOUND IMAGE LOCALIZATION CONTROL APPARATUS

(75) Inventors: Ko Mizuno, Kyoto (JP); Hiroyuki Kano, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 714 days.

(21) Appl. No.: 13/595,194

(22) Filed: Aug. 27, 2012

(65) Prior Publication Data

US 2012/0314889 A1 Dec. 13, 2012

Related U.S. Application Data

(62) Division of application No. 11/579,168, filed as application No. PCT/JP2006/300817 on Jan. 20, 2006, now abandoned.

(30) Foreign Application Priority Data

Jan. 24, 2005 (JP) ..... 2005-015618

(51) Int. Cl.
*H04R 5/02* (2006.01)
*H04S 3/00* (2006.01)

(52) U.S. Cl.
CPC ..... *H04S 3/002* (2013.01)

(58) Field of Classification Search
CPC . H04R 5/023; H04R 2499/13; B60R 11/0217
USPC ..... 381/17, 86, 92, 302, 27, 303, 307, 24
See application file for complete search history.

(56) References Cited

U.S. PATENT DOCUMENTS 5,068,897 A * 11/1991 Yamato et al. ..... 381/302
5,754,664 A * 5/1998 Clark et al. ..... 381/86

(Continued)

FOREIGN PATENT DOCUMENTS

EP 1 427 254 6/2004
JP 60-134393 9/1985

(Continued)

OTHER PUBLICATIONS

Bauck and Cooper, "Generalized Transaural Stereo and Applications", Journal of AES, vol. 44, No. 9, Sep. 1996.

(Continued)

*Primary Examiner* — Davetta W Goins
*Assistant Examiner* — Kuassi Ganmavo
(74) *Attorney, Agent, or Firm* — Wenderoth, Lind & Ponack, L.L.P.

(57) ABSTRACT

An audio signal high frequency component controlled in terms of directivity is reproduced, or an audio signal high frequency component compensated in terms of frequency characteristic or controlled in terms of directivity is reproduced, such that the reflected sound comes from a direction in which the high frequency component is intended to be localized. The sound pressure in a seat where a desired localization effect is not provided due to the arrangement of speakers is compensated such that the interaural amplitude level in the seat is equal to that of another seat. Thus, an equivalent level of localization effect is provided in a plurality of seats, especially for an audio signal high frequency component, without significantly increasing the number of the speakers.

5 Claims, 21 Drawing Sheets

(56) References Cited

U.S. PATENT DOCUMENTS

| | | | | |
|---|---|---|---|---|
| 6,501,843 | B2 | 12/2002 | Usui et al. | |
| 7,386,139 | B2 * | 6/2008 | Hashimoto et al. | 381/310 |
| 2004/0047476 | A1 * | 3/2004 | Sato | 381/89 |
| 2008/0037794 | A1 * | 2/2008 | Sugawara et al. | 381/1 |
| 2011/0268298 | A1 * | 11/2011 | Imanishi et al. | 381/303 |
| 2012/0155651 | A1 * | 6/2012 | Obata et al. | 381/17 |

FOREIGN PATENT DOCUMENTS

| | | |
|---|---|---|
| JP | 63-217899 | 9/1988 |
| JP | 02-285800 | 11/1990 |
| JP | 03-28900 | 3/1991 |
| JP | 04-69000 | 3/1992 |
| JP | 06-072253 | 3/1994 |
| JP | 06-165298 | 6/1994 |
| JP | 07-162998 | 6/1995 |
| JP | 2000-236598 | 8/2000 |
| JP | 2002-095096 | 3/2002 |
| JP | 2004-194315 | 7/2004 |

OTHER PUBLICATIONS

Rumsey, Francis. Spatial Audio. Focal Press, 2001. pp. 21-29.

* cited by examiner

SOUND IMAGE LOCALIZATION CONTROL APPARATUS

CROSS-REFERENCE TO RELATED APPLICATION

This application is a Divisional of U.S. application Ser. No. 11/579,168, filed Oct. 31, 2006, which is a national stage application of International application No. pct/jp2006/300817, filed Jan. 20, 2006, the entireties of which are incorporated herein by reference.

BACKGROUND OF THE INVENTION

I. Technical Field

The present invention relates to a sound image localization control apparatus.

II. Description of the Related Art

Conventionally, when reproducing music, a movie or other contents in a vehicle, the sense of sound image localization is improved by adjusting gain balance or time alignment through delay insertion among speakers. With such a method, however, it is difficult to improve the sense of sound image localization at different seats with substantially the same degree. In order to solve this problem, an apparatus for erasing crosstalk among a plurality of speakers is proposed. Hereinafter, an audio reproduction apparatus described in Japanese Laid-Open Patent Publication No. 6-165298 will be described with reference to the figures.

FIG. 1 shows an audio reproduction apparatus described in Japanese Laid-Open Patent Publication No. 6-165298. In this figure, an audio reproduction apparatus 1 is applied to front seats of a vehicle. Specifically, two crew members L1 and L2 as listeners in the vehicle listen to a signal B1 reproduced by a recording device 2 with their left ears and to a signal B2 reproduced by the recording device with their right ears. Thus, both crew members perceive an audio effect of a content included in the recording device 2. In front of the crew members L1 and L2, four speakers 3*a* through 3*d* are provided, which are respectively connected to amplifiers 4*a* through 4*d*. Each set of a speaker and an amplifier forms audio generation means. The recording device 2 has audio information therein which is recorded by a known binaural recording system. The recording device 2 and the amplifiers 4*a* through 4*d* are connected to each other via an inverse filter network 5 constructed by the following procedure.

Before constructing the inverse filter network 5, an acoustic transfer function hij (i=1 through 4: subscript representing an ear; j=1 through 4: subscript representing a speaker) from each of the speakers 3*a* through 3*d* to each ear of each crew member is measured. The acoustic transfer functions other than h11, h21, h31 and h41 are not shown in the figure. FIG. 2 shows a method for measuring an acoustic transfer function hij. A test signal generation device 6 connected to the amplifiers 4*a* through 4*d* generates a wideband signal such as white noise or the like, and measures acoustic transfer functions hij using sounds S1 through S4 generated from the speakers 3*a* through 3*d* and sounds M1 through M4 measured at both ears of dummy heads D1 and D2 which are located at positions at which crew members are assumed to be sitting. In actuality, the speakers are driven sequentially. Namely, for example, while the speaker 3*a* is driven, the other speakers 3*b* through 3*d* are not driven. The generated sounds S1 through S4, the measured sounds M1 through M4, and the acoustic transfer functions fulfill the following relationships.

[Expression 1]

$$\begin{bmatrix} M_1 \\ M_2 \\ M_3 \\ M_4 \end{bmatrix} = \begin{bmatrix} h_{11} & h_{12} & h_{13} & h_{14} \\ h_{21} & h_{22} & h_{23} & h_{24} \\ h_{31} & h_{32} & h_{33} & h_{34} \\ h_{41} & h_{42} & h_{43} & h_{44} \end{bmatrix} \begin{bmatrix} S_1 \\ S_2 \\ S_3 \\ S_4 \end{bmatrix} \tag{1}$$

A target effect to be provided by the audio reproduction apparatus 1 is:

[Expression 2]

$$\begin{bmatrix} M_1 \\ M_2 \\ M_3 \\ M_4 \end{bmatrix} = \begin{bmatrix} 1 & 0 & 0 & 0 \\ 0 & 1 & 0 & 0 \\ 0 & 0 & 1 & 0 \\ 0 & 0 & 0 & 1 \end{bmatrix} \begin{bmatrix} B_1 \\ B_2 \\ B_1 \\ B_2 \end{bmatrix} \tag{2}$$

Expression (2) can be modified into:

[Expression 3]

$$\begin{bmatrix} M_1 \\ M_2 \\ M_3 \\ M_4 \end{bmatrix} = \begin{bmatrix} h_{11} & h_{12} & h_{13} & h_{14} \\ h_{21} & h_{22} & h_{23} & h_{24} \\ h_{31} & h_{32} & h_{33} & h_{34} \\ h_{41} & h_{42} & h_{43} & h_{44} \end{bmatrix} \begin{bmatrix} h_{11} & h_{12} & h_{13} & h_{14} \\ h_{21} & h_{22} & h_{23} & h_{24} \\ h_{31} & h_{32} & h_{33} & h_{34} \\ h_{41} & h_{42} & h_{43} & h_{44} \end{bmatrix}^{-1} \begin{bmatrix} B_1 \\ B_2 \\ B_1 \\ B_2 \end{bmatrix} \tag{3}$$

The following Expressions are obtained by substituting expression (1) for expression (3).

[Expression 4]

$$\begin{bmatrix} S_1 \\ S_2 \\ S_3 \\ S_4 \end{bmatrix} = \begin{bmatrix} h_{11} & h_{12} & h_{13} & h_{14} \\ h_{21} & h_{22} & h_{23} & h_{24} \\ h_{31} & h_{32} & h_{33} & h_{34} \\ h_{41} & h_{42} & h_{43} & h_{44} \end{bmatrix}^{-1} \begin{bmatrix} B_1 \\ B_2 \\ B_1 \\ B_2 \end{bmatrix} \tag{4}$$

[Expression 5]

$$\begin{bmatrix} h_{11} & h_{12} & h_{13} & h_{14} \\ h_{21} & h_{22} & h_{23} & h_{24} \\ h_{31} & h_{32} & h_{33} & h_{34} \\ h_{41} & h_{42} & h_{43} & h_{44} \end{bmatrix}^{-1} = \frac{1}{|H|} \begin{bmatrix} H_{11} & H_{21} & H_{31} & H_{41} \\ H_{12} & H_{22} & H_{32} & H_{42} \\ H_{13} & H_{23} & H_{33} & H_{43} \\ H_{14} & H_{24} & H_{34} & H_{44} \end{bmatrix}$$

The inverse filter network 5 as shown in FIG. 1 is designed so as to fulfill expression (4) and provided in front of the amplifiers 4*a* through 4*d*. A signal for the left ear and a signal for the right ear are input to the inverse filter network 5 instead of an output from the test signal generation device 6. Then, the signals listened to by the left ear and the right ear of the dummy heads D1 and D2 are respectively a signal for the left ear and a signal for the right ear. It is assumed that in the inverse filter network 5 shown in FIG. 1, the signal for the left ear is input to an input section shown on a left part of the sheet of FIG. 1, and the signal for the right ear is input to an input section shown in a right part of the sheet of FIG. 1. Components included in the inverse filter network 5 are expressed by the following expressions.

[Expression 6]

$$|H| = h_{11}\begin{bmatrix} h_{22} & h_{23} & h_{24} \\ h_{32} & h_{33} & h_{34} \\ h_{42} & h_{43} & h_{44} \end{bmatrix} - h_{12}\begin{bmatrix} h_{21} & h_{23} & h_{24} \\ h_{31} & h_{33} & h_{34} \\ h_{41} & h_{43} & h_{44} \end{bmatrix} + h_{13}\begin{bmatrix} h_{21} & h_{22} & h_{24} \\ h_{31} & h_{32} & h_{34} \\ h_{41} & h_{42} & h_{44} \end{bmatrix} - h_{14}\begin{bmatrix} h_{21} & h_{22} & h_{23} \\ h_{31} & h_{32} & h_{33} \\ h_{41} & h_{42} & h_{43} \end{bmatrix}$$

[Expression 7]

$$H_{11} = +\left\{h_{22}\begin{bmatrix} h_{33} & h_{34} \\ h_{43} & h_{44} \end{bmatrix} - h_{23}\begin{bmatrix} h_{32} & h_{34} \\ h_{42} & h_{44} \end{bmatrix} + h_{24}\begin{bmatrix} h_{32} & h_{33} \\ h_{42} & h_{43} \end{bmatrix}\right\}$$

[Expression 8]

$$H_{12} = -\left\{h_{21}\begin{bmatrix} h_{33} & h_{34} \\ h_{43} & h_{44} \end{bmatrix} - h_{23}\begin{bmatrix} h_{31} & h_{34} \\ h_{41} & h_{44} \end{bmatrix} + h_{24}\begin{bmatrix} h_{31} & h_{33} \\ h_{41} & h_{43} \end{bmatrix}\right\}$$

[Expression 9]

$$H_{13} = +\left\{h_{21}\begin{bmatrix} h_{32} & h_{34} \\ h_{42} & h_{44} \end{bmatrix} - h_{22}\begin{bmatrix} h_{31} & h_{34} \\ h_{41} & h_{44} \end{bmatrix} + h_{24}\begin{bmatrix} h_{31} & h_{32} \\ h_{41} & h_{42} \end{bmatrix}\right\}$$

[Expression 10]

$$H_{14} = -\left\{h_{21}\begin{bmatrix} h_{32} & h_{33} \\ h_{42} & h_{43} \end{bmatrix} - h_{22}\begin{bmatrix} h_{31} & h_{33} \\ h_{41} & h_{43} \end{bmatrix} + h_{23}\begin{bmatrix} h_{31} & h_{32} \\ h_{41} & h_{42} \end{bmatrix}\right\}$$

[Expression 11]

$$H_{21} = -\left\{h_{12}\begin{bmatrix} h_{33} & h_{34} \\ h_{43} & h_{44} \end{bmatrix} - h_{13}\begin{bmatrix} h_{32} & h_{34} \\ h_{42} & h_{44} \end{bmatrix} + h_{14}\begin{bmatrix} h_{32} & h_{33} \\ h_{42} & h_{43} \end{bmatrix}\right\}$$

[Expression 12]

$$H_{22} = +\left\{h_{11}\begin{bmatrix} h_{33} & h_{34} \\ h_{43} & h_{44} \end{bmatrix} - h_{13}\begin{bmatrix} h_{31} & h_{34} \\ h_{41} & h_{44} \end{bmatrix} + h_{14}\begin{bmatrix} h_{31} & h_{33} \\ h_{41} & h_{43} \end{bmatrix}\right\}$$

[Expression 13]

$$H_{23} = -\left\{h_{11}\begin{bmatrix} h_{32} & h_{34} \\ h_{42} & h_{44} \end{bmatrix} - h_{12}\begin{bmatrix} h_{31} & h_{34} \\ h_{41} & h_{44} \end{bmatrix} + h_{14}\begin{bmatrix} h_{31} & h_{32} \\ h_{41} & h_{42} \end{bmatrix}\right\}$$

[Expression 14]

$$H_{24} = +\left\{h_{11}\begin{bmatrix} h_{32} & h_{33} \\ h_{42} & h_{43} \end{bmatrix} - h_{12}\begin{bmatrix} h_{31} & h_{33} \\ h_{41} & h_{43} \end{bmatrix} + h_{13}\begin{bmatrix} h_{31} & h_{32} \\ h_{41} & h_{42} \end{bmatrix}\right\}$$

[Expression 15]

$$H_{31} = +\left\{h_{12}\begin{bmatrix} h_{23} & h_{24} \\ h_{43} & h_{44} \end{bmatrix} - h_{13}\begin{bmatrix} h_{22} & h_{24} \\ h_{42} & h_{44} \end{bmatrix} + h_{14}\begin{bmatrix} h_{22} & h_{23} \\ h_{42} & h_{43} \end{bmatrix}\right\}$$

[Expression 16]

$$H_{32} = -\left\{h_{11}\begin{bmatrix} h_{23} & h_{24} \\ h_{43} & h_{44} \end{bmatrix} - h_{13}\begin{bmatrix} h_{21} & h_{24} \\ h_{41} & h_{44} \end{bmatrix} + h_{14}\begin{bmatrix} h_{21} & h_{23} \\ h_{41} & h_{43} \end{bmatrix}\right\}$$

[Expression 17]

$$H_{33} = +\left\{h_{11}\begin{bmatrix} h_{22} & h_{24} \\ h_{42} & h_{44} \end{bmatrix} - h_{12}\begin{bmatrix} h_{21} & h_{24} \\ h_{41} & h_{44} \end{bmatrix} + h_{14}\begin{bmatrix} h_{21} & h_{22} \\ h_{41} & h_{42} \end{bmatrix}\right\}$$

[Expression 18]

$$H_{34} = -\left\{h_{11}\begin{bmatrix} h_{22} & h_{23} \\ h_{42} & h_{43} \end{bmatrix} - h_{12}\begin{bmatrix} h_{21} & h_{23} \\ h_{41} & h_{43} \end{bmatrix} + h_{13}\begin{bmatrix} h_{21} & h_{22} \\ h_{41} & h_{42} \end{bmatrix}\right\}$$

[Expression 19]

$$H_{41} = -\left\{h_{12}\begin{bmatrix} h_{23} & h_{24} \\ h_{33} & h_{34} \end{bmatrix} - h_{13}\begin{bmatrix} h_{22} & h_{24} \\ h_{32} & h_{34} \end{bmatrix} + h_{14}\begin{bmatrix} h_{22} & h_{23} \\ h_{32} & h_{33} \end{bmatrix}\right\}$$

[Expression 20]

$$H_{42} = +\left\{h_{11}\begin{bmatrix} h_{23} & h_{24} \\ h_{33} & h_{34} \end{bmatrix} - h_{13}\begin{bmatrix} h_{21} & h_{24} \\ h_{31} & h_{34} \end{bmatrix} + h_{14}\begin{bmatrix} h_{21} & h_{23} \\ h_{31} & h_{33} \end{bmatrix}\right\}$$

-continued

[Expression 21]

$$H_{43} = -\left\{h_{11}\begin{bmatrix} h_{22} & h_{24} \\ h_{32} & h_{34} \end{bmatrix} - h_{12}\begin{bmatrix} h_{21} & h_{24} \\ h_{31} & h_{34} \end{bmatrix} + h_{14}\begin{bmatrix} h_{21} & h_{22} \\ h_{41} & h_{32} \end{bmatrix}\right\}$$

[Expression 22]

$$H_{44} = +\left\{h_{11}\begin{bmatrix} h_{22} & h_{23} \\ h_{32} & h_{33} \end{bmatrix} - h_{12}\begin{bmatrix} h_{21} & h_{23} \\ h_{31} & h_{33} \end{bmatrix} + h_{13}\begin{bmatrix} h_{21} & h_{22} \\ h_{31} & h_{32} \end{bmatrix}\right\}$$

In the case where the signals B1 and B2 recorded by the binaural system are processed by the inverse filter network 5 constructed in this manner, the sound reaching the position of the left ear of the crew members L1 and L2 is of the signal B1, and the sound reaching the position of the right ear of the crew members L1 and L2 is of the signal B2. Therefore, both crew members can listen to the original sound field.

In the case where the structure shown in Japanese Laid-Open Patent Publication No. 6-165298 is provided with control means for processing an output from the recording device 2 with a digital filter or the like which simulates a predetermined acoustic transfer function and inputting the resultant signal to the inverse filter network 5, the sound image can be localized in a predetermined direction. FIG. 3 shows acoustic transfer functions G1 and G2 from a virtual sound source 7 to the left ear and the right ear of the dummy head D1. FIG. 4 shows an audio reproduction apparatus for localizing a sound image in a predetermined direction. In FIG. 4, elements equivalent to those in FIG. 1 bear identical reference numerals thereto. For filters 8*a* and 8*b*, predetermined acoustic transfer functions G1 and G2 are set as coefficients. As a sound source, a monaural sound source 9 having a monaural signal B0 recorded therein is used, not a sound recorded by the binaural system. In the structure shown in FIG. 4, the sounds at the positions of the left ear and the right ear of the crew members L1 and L2 are respectively G1•B0 and G2•B0 according to the above description. Therefore, the crew members L1 and L2 obtain a perception as if the sound was generated by the virtual sound source 7 shown in FIG. 3. The monaural signal B0 may be processed with the acoustic transfer functions G1 and G2 in advance, or the acoustic transfer functions G1 and G2 may be incorporated as elements of the inverse filter network 5. In these cases, substantially the same effect is provided.

SUMMARY OF THE INVENTION

In the audio generation apparatuses shown in FIG. 1 and FIG. 4, the inverse filter network 5 is constructed such that the acoustic transfer function becomes 1 by synthesizing transfer functions in consideration of the amplitude and the phase at the positions of both ears of the crew members L1 and L2. Therefore, when the crew members L1 and L2 move their heads, the acoustic transfer function hji is varied. Due to the offset in the phase, the gain at the time of synthesis of the transfer functions is deteriorated. The acoustic transfer function results in not being 1. The deterioration is especially conspicuous with a high frequency component where the sound wavelength is short. For example, in the case of a sound wave of 3 kHz included in the voice band, the wavelength is about 11 cm. When the head is moved by about 3 cm, which is ¼ of the wavelength, the precision of synthesis is deteriorated and thus a desired acoustic transfer function cannot be obtained. In order to solve such a problem, it is possible to broaden the area in which the acoustic transfer function is 1 by increasing the number of speakers and the number of positions to be controlled. However, this causes another problem that the space for the speakers is enlarged and the scale of the filter device is significantly enlarged. This approach does not solve the fundamental problem.

Another possible approach is shown in FIG. 5. FIG. 5 shows an apparatus for causing the crew members L1 and L2 to perceive localization of an R-channel signal of an audio signal in a desired direction over the entire frequency band. In FIG. 5, reference numerals 10*a* through 10*d* represent low frequency reproduction speakers attached to doors of a vehicle 16; reference numeral 11 represents an R-channel high frequency reproduction speaker attached to a right front door pillar of the vehicle 16; reference numeral 12 represents a low pass filter for extracting a low frequency component of an input R-channel signal; reference numeral 13 represents a high pass filter for extracting a high frequency component of the input R-channel signal; reference numeral 14 represents a delay device; and reference numeral 15 represents a gain device. In FIG. 5, elements operating in an identical manner to those in FIG. 4 bear identical reference numerals thereto. In the apparatus shown in FIG. 5, for a low frequency component, the filters 8*a* and 8*b* and the inverse filter network 5 operate so as to realize a desired transfer function at the positions of the ears of the crew members L1 and L2 as described with reference to FIG. 4. A high frequency component is reproduced from the R-channel high frequency reproduction speaker 11 without being processed by the inverse filter network 5. The delay device 14 and the gain device 15 adjust the phase and the gain of the high frequency component such that the crew members L1 and L2 do not sense any unnaturalness regarding the high frequency component with respect to the low frequency component. By the above-described operation, the crew members L1 and L2 perceive a sound image of the R-channel high frequency component at the position of the right front door pillar or the vicinity thereof. Since the control by the synthesis of the transfer functions is not used, the sound image localization effect is not deteriorated even if the crew members move their heads slightly. However, this causes another problem as follows regarding the direction in which the sound image is localized.

FIG. 6 shows directions of sound images perceived by crew members L1 and L2. For example, when a low frequency component is localized in the direction of 60 degrees on the right, the high frequency component is also localized in the direction of about 60 degrees on the right for the crew member L1 because the R-channel high frequency reproduction speaker 11 is located in the direction of about 60 degrees on the right. Therefore, superb sound localization is realized. By contrast, for the crew member L2, the R-channel high frequency reproduction speaker 11 is located in the direction of about 30 degrees on the right, and therefore the high frequency component is located in the direction of 30 degrees on the right. The direction of localization of the high frequency component is not matched to the direction of localization of the low frequency component. Therefore, the crew member L2 obtains a sense of unnaturalness. In the case where the high frequency reproduction speaker is located in a direction in which the sound image is intended to be localized, the same sound image cannot be provided at a plurality of seats.

The present invention, in light of the above-described problems, has an object of providing a vehicle-mountable sound image localization control apparatus for realizing an equivalent localization effect at a plurality of seats without increasing the number of speakers significantly.

To achieve the above objects, the present invention has the following features. The reference numerals and numbers of the figures in parentheses in this section of the specification indicate the correspondence with the figures for easier understanding of the present invention and do not limit the present invention in any way.

A sound image localization control apparatus according to the present invention comprises audio reproduction means or device (19*a* through 19*c*, 11*c* through 11*e*) for generating a sound wave based on an audio signal; and directivity control means or device (20, 20*d*) for processing the audio signal to be input to the audio reproduction means, such that an interaural amplitude level difference obtained when a first listener (L1) located at a first listening position listens to a reproduction sound provided by the audio reproduction means is equal to an interaural amplitude level difference obtained when a second listener (L2) located at a second listening position listens to the reproduction sound provided by the audio reproduction means.

The directivity control means may process the audio signal such that a difference between the interaural amplitude level difference obtained when the first listener listens to the reproduction sound and the interaural amplitude level difference obtained when the second listener listens to the reproduction sound is 10 dB or less.

The directivity control means may include one-ear directivity control means or device (20*d*) for processing the audio signal such that the reproduction sound provided by the audio reproduction means is directed toward only a first ear, which is one ear of the second listener.

The directivity control means may further include frequency characteristic compensation means or device (34) for compensating a frequency characteristic of the audio signal to be input to the audio reproduction means via the one-ear directivity control means.

The frequency characteristic compensation means may compensate the frequency characteristic of the audio signal to be input to the audio reproduction means via the one-ear directivity control means, based on a frequency characteristic (FIG. 12A) of the interaural amplitude level difference of a head-related acoustic transfer function corresponding to a direction in which the first listener perceives a sound image of the reproduction sound from the audio reproduction means.

The sound image localization control apparatus may further comprise input means for inputting an instruction from the first listener or the second listener. The frequency characteristic compensation means may compensate the frequency characteristic of the audio signal to be input to the audio reproduction means via the one-ear directivity control means into a frequency characteristic corresponding to the instruction from the first listener or the second listener which is input by the input means.

The directivity control means may further include three-ear directivity control means or device (20*c*) for processing the audio signal such that the reproduction sound provided by the audio reproduction means is directed toward both ears of the first listener and a second ear of the second listener which is different from the first ear. The audio reproduction means may generate the sound wave based on an audio signal processed by the one-ear directivity control means and an audio signal processed by the three-ear directivity control means.

The directivity control means may include second listener directivity control means or device (20) for processing the audio signal, such that the reproduction sound provided by the audio reproduction means is directed toward an obstacle located on the side of the second listener, is reflected by the obstacle, and then is directed toward the second listener.

The directivity control means may be installed in a vehicle; and the obstacle may be a side face of the vehicle (door, etc.).

The audio reproduction means may be installed in a front part in the vehicle.

The audio signal may include at least an R-channel audio signal and an L-channel audio signal. The audio reproduction means may be installed equidistantly from the first listening position and the second listening position. The directivity control means may include second listener directivity control means for processing the audio signal, such that a reproduction sound of an R-channel audio signal provided by the audio reproduction means is directed toward an obstacle located on the side of the second listener, is reflected by the obstacle, and then is directed toward the second listener; first listener directivity control means or device (20*a*) for processing the audio signal, such that a reproduction sound of an L-channel audio signal provided by the audio reproduction means is directed toward an obstacle located on the side of the first listener, is reflected by the obstacle, and then is directed toward the first listener; and addition means or device (31*a* through 31*c*) for adding the R-channel audio signal processed by the second listener directivity control means or device (20*b*) and the L-channel audio signal processed by the first listener directivity control means and inputting the addition result to the audio reproduction means.

An integrated circuit according to the present invention is usable in electric connection to audio reproduction means or device (19*a* through 19*c*, 11*c* through 11*e*) for generating a sound wave based on an audio signal. The integrated circuit comprises an input terminal for inputting the audio signal; directivity control means or device (20, 20*d*) for processing the audio signal supplied via the input means, such that an interaural amplitude level difference obtained when a first listener (L1) located at a first listening position listens to a reproduction sound provided by the audio reproduction means is equal to an interaural amplitude level difference obtained when a second listener (L2) located at a second listening position listens to the reproduction sound provided by the audio reproduction means; and an output terminal for supplying the audio signal processed by the directivity control means to the audio reproduction means.

As described above, according to the present invention, the audio signal to be input to the audio reproduction means is processed, such that an interaural amplitude level difference obtained when a reproduction sound provided by the audio reproduction means is listened to at a first listening position is equal to an interaural amplitude level difference obtained when the reproduction sound is listened to at a second listening position different from the first listening position. Thus, the same level of sound image localization effect is provided at a plurality of listening positions.

DETAILED DESCRIPTION OF THE INVENTION

Hereinafter, the present invention will be described by way of various embodiments with reference to FIG. 7 through FIG. 25.

First Embodiment

Figure 7:
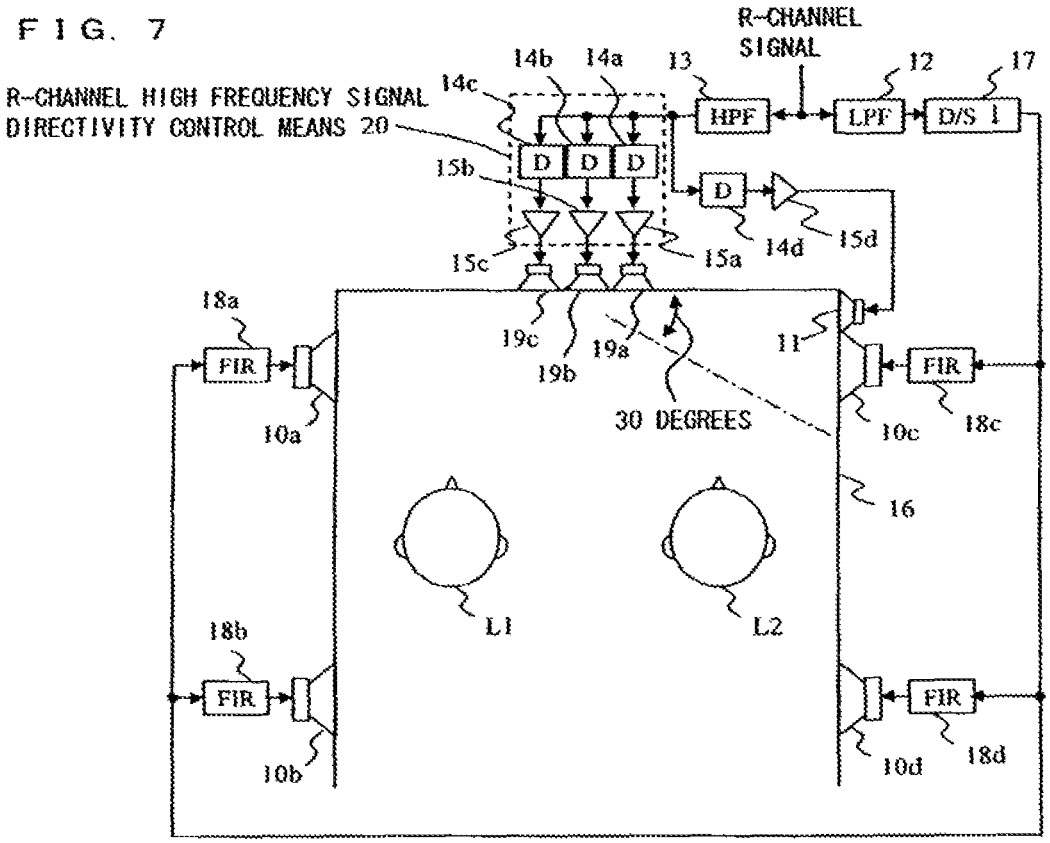
FIG. 7 shows a vehicle-mountable sound image localization control apparatus according to a first embodiment of the present invention.

FIG. 7 shows a vehicle-mountable sound image localization control apparatus according to a first embodiment. The vehicle-mountable sound image localization control apparatus shown in FIG. 7 allows both the crew members L1 and L2 located in front seats of the vehicle 16 to perceive localization of a sound image of an R-channel signal of an audio signal in a desired direction over the entire frequency band. For a home-use audio system allowing listeners to enjoy music contents or the like including L and R sound sources, it is recommended to localize the L and R sound sources at 30 degrees on the left and 30 degrees on the right. By contrast, in a vehicle, it is preferred to localize the L and R sound sources at larger angles of about 60 degrees on the left and about 60 degrees on the right. The reason is that if the L and R sound sources are localized at 30 degrees on the left and 30 degrees on the right, the listeners feels suppressed due to the specific condition that the vehicle has a narrow and closed inner space. In the following description, it is assumed that the vehicle-mountable sound image localization control apparatus is operated for the purpose of localizing an R sound source in the direction of 60 degrees on the right as an example.

In FIG. 7, reference numerals 10*a* through 10*d* represent low frequency reproduction speakers attached to doors; reference numeral 11 represents a high frequency reproduction speaker attached to a front door pillar; reference numeral 12 represents a low pass filter; reference numeral 13 represents a high pass filter; reference numerals 14*a* through 14*d* represent delay devices; reference numeral 15*a* through 15*d* represent gain devices; reference numeral 17 represents a downsampling converter; reference numerals 18*a* through 18*d* represent low frequency localization control FIR filters; reference numeral 19*a* through 19*c* represent speakers of a high frequency reproduction speaker array attached at the center of a dashboard at an equal interval; and reference numeral 20 represents R-channel high frequency signal directivity control means including the delay devices 14*a* through 14*d* and the gain devices 15*a* through 15*c*. An A/D converter, a D/A converter, an anti-alias filter, and a speaker driving amplifier are provided at known positions and are not shown here.

The functions of the lowpass filter, the high pass filter, the delay devices, the gain devices, the downsampling converter, the low frequency localization control FIR filters, and elements such as the converters and the like which are not shown here may be partially or entirely realized by a one-chip integrated circuit. Such an integrated circuit may be realized as an LSI, a dedicated circuit or a multi-purpose processor. Alternatively, an FPGA (Field Programmable Gate Array) which is programmable after LSI production, or a reconfigurable processor in which the connection or setting of circuit cells in the LSI is reconfigurable, is usable. When the development of the semiconductor technology and generation of other technologies derived therefrom produce integration techniques replacing the LSI, the above elements may be integrated using such techniques. Needless to say, the integrated circuit includes an input terminal for inputting an audio signal and an output terminal for supplying the audio signal processed by the integrated circuit to each speaker. In the following embodiments and modifications thereof also, the functions of the elements may be partially or entirely realized by a one-chip integrated circuit.

Next, a localization control operation of the vehicle-mountable sound image localization control apparatus will be described.

First, a method for designing the low frequency localization control FIR filters 18*a* through 18*d* and a localization control operation on a low frequency component will be described. The low frequency band and the high frequency band are preferably defined as follows. A frequency band in which the sound image localization effect is likely to be spoiled by an offset in the position at which the sound is listened is the high frequency, and the remaining frequency band is the low frequency band. The border between the high frequency band and the low frequency band is, for example, 1 kHz, but is not limited to 1 kHz.

Figure 8:
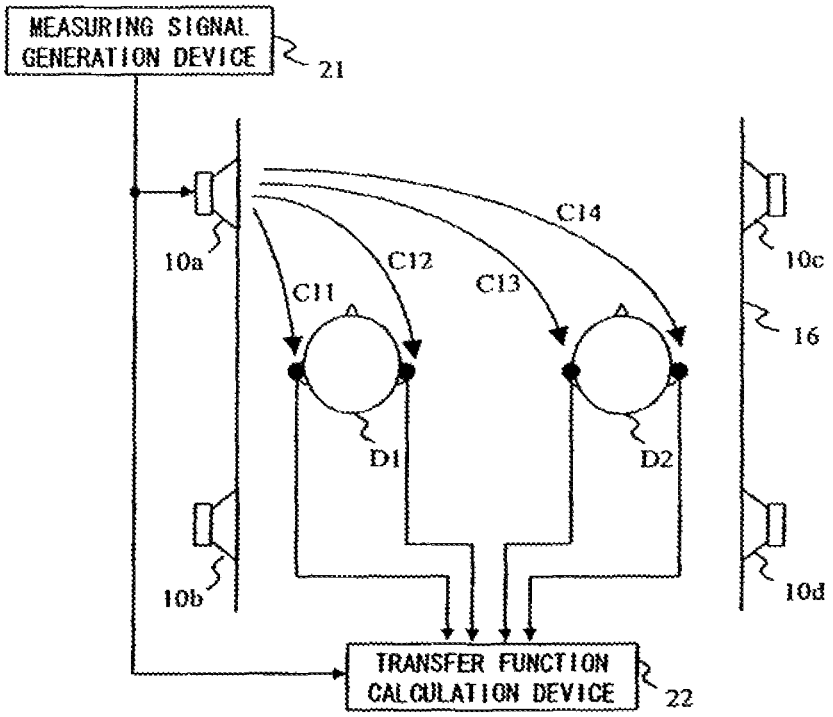
FIG. 8 shows a method for measuring transfer functions.
Figure 9:
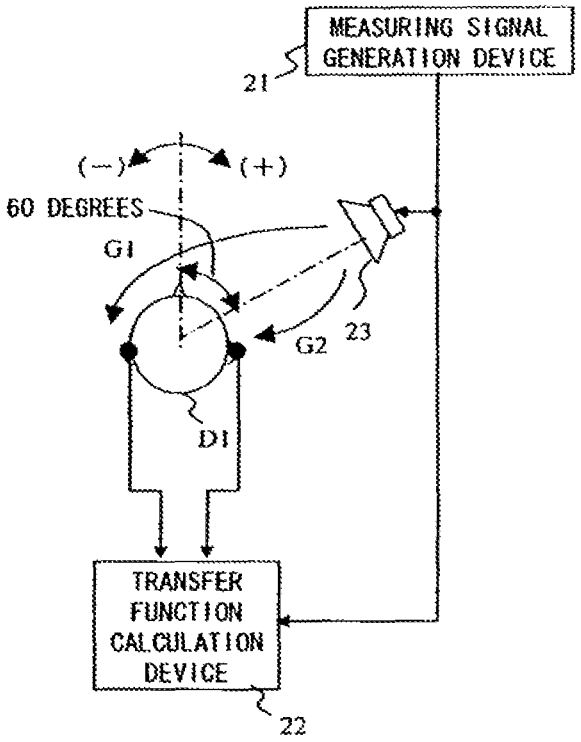
FIG. 9 shows a method for measuring target transfer functions.
Figure 10:
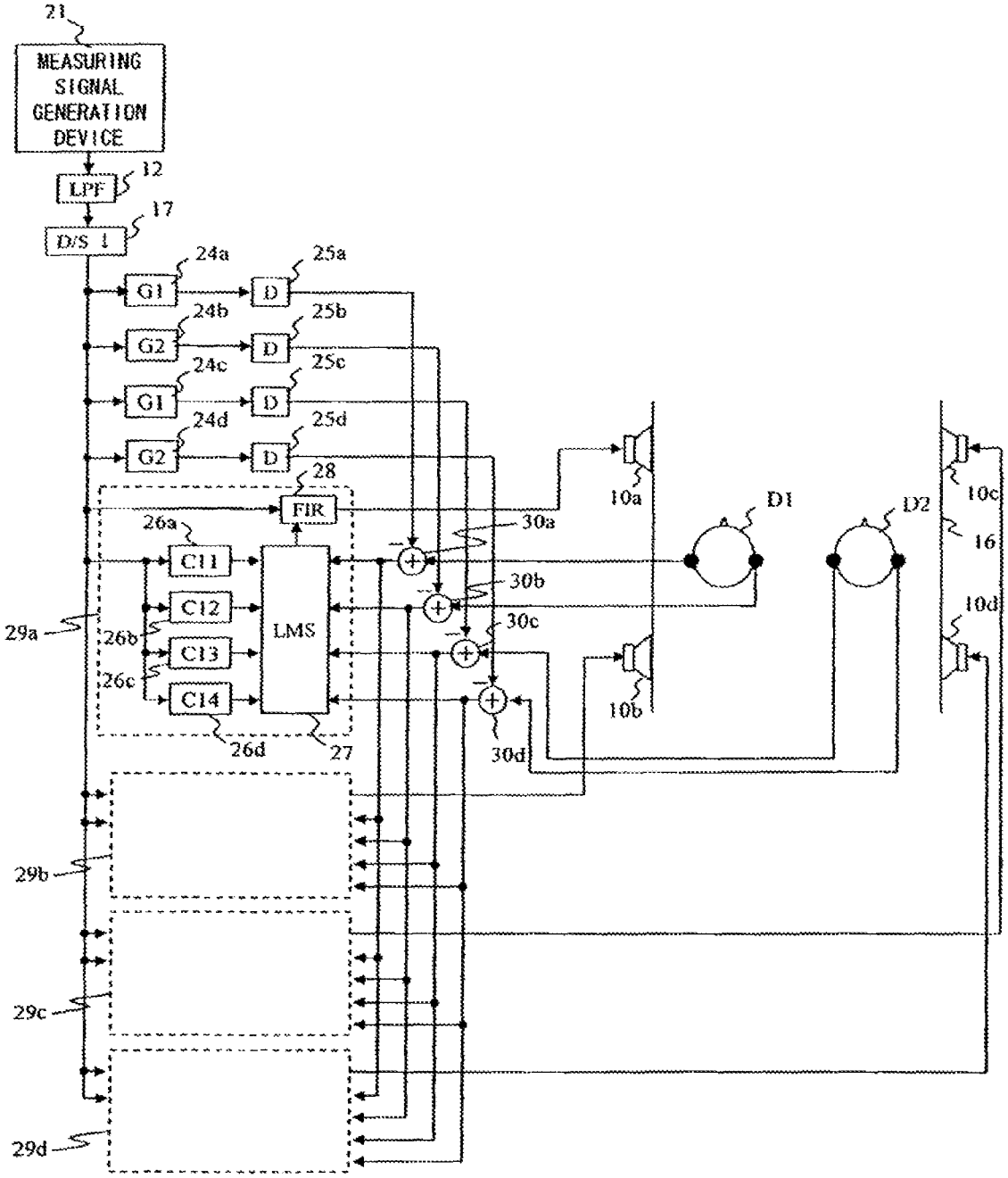
FIG. 10 shows a structure for designing a low frequency localization control FIR filter.

FIG. 8 shows a structure for measuring transfer functions C1*j* (j=1 through 4) from the low frequency reproduction speaker 10*a* to the ears of the dummy heads D1 and D2. The transfer functions C1*j* are measured as follows. A measuring signal generation device 21 generates a wideband signal such as white noise or the like, and a transfer function calculation device 22 measures the transfer functions C1*j* by a known transfer function measuring method, such as adaptation identification, using an output signal from the measuring signal generation device 21 and the signals measured at both ears of the dummy heads D1 and D2. Similarly, transfer functions Cij (i=2 through 4; j=1 through 4) from the low frequency reproduction speakers 10*b* through 10*d* to the ears of the dummy heads D1 and D2 are measured. FIG. 9 shows a structure for measuring a target transfer function which should be realized at the positions of the ears of the crew members L1 and L2 in FIG. 7. Where the front direction is 0 degrees, the clockwise direction is a positive direction and the counterclockwise direction is a negative direction, a sound image of the R-channel signal is localized in the direction of +60 degrees as follows. The dummy head D1 and a speaker 23 are set in an anechoic chamber. The speaker 23 is set in the direction of +60 degrees. A wideband signal such as white noise or the like generated by the measuring signal generation device 21 is input to the speaker 23. The transfer function calculation device 22 measures target transfer functions G1 and G2 using the output signal from the measuring signal generation device 21 and the signals measured at both ears of the dummy head D1. Next, the low frequency localization control FIR filters 18*a* through 18*d* are designed by an adaptable (filtered X-LMS) algorithm using the transfer functions Cij and the target transfer functions G1 and G2. FIG. 10 shows a structure for such designing. In FIG. 10, reference numerals 24*a* through 24*d* represent target transfer function filters having, as coefficients, target transfer functions to be realized at both ears of the dummy heads D1 and D2. For the coefficients, the transfer functions G1 and G2 obtained by the above-described measurement are applied. For realizing different transfer functions at the dummy heads D1 and D2, the target transfer function of the dummy head D1 is set for the target transfer function filters 24*a* and 24*b*, and the target transfer function of the dummy head D2 is set for the target transfer function filters 24*c* and 24*d*. Reference numerals 25*a* through 25*d* represent the delay devices. For these delay devices, a delay value necessary for converging adaptable calculation is set. The same delay value needs to be set in the delay devices 25*a* through 25*d*. Reference numerals 26*a* through 26*d* represent error path filters used for the filtered X-LMS algorithm. The transfer functions C11, C12, C13 and C14 from the low frequency reproduction speaker 10*a* to both ears of the dummy heads D1 and D2 can be set as coefficients of the error path filters 26*a* through 26*d*. Reference numeral 27 represents a coefficient update calculation section based on the known LMS algorithm. Reference numeral 28 represents an adaptable filter, the filter coefficient of which is updated at every sampling period based on the output from the coefficient update calculation section 27. An output from the adaptable filter 28 drives the low frequency reproduction speaker 10*a*. Reference numeral 29*a* represents an adaptable filter calculation section for calculating a filter coefficient of the FIR filter 18 for driving the low frequency reproduction speaker 10*a*. Adaptable filter calculation sections 29*b* through 29*d* for calculating a filter coefficient of the adaptable filter for driving the low frequency reproduction speakers 10*b* through 10*d* have substantially the same structure. Reference numerals 30*a* through 30*d* represent adders. The adders 30*a* through 30*d* input a value obtained by subtracting the outputs from the target transfer function filters 24*a* through 24*d* from the signals measured at both ears of the dummy heads D1 and D2 to the coefficient update calculation section 27 as error signals. The other elements shown in FIG. 10 operate in an identical manner to those shown in FIG. 7 and FIG. 8 and bear identical reference numerals thereto. By the operation described so far, the filter coefficients calculated by the adaptable filter calculation sections 29*a* through 29*d* are set in the low frequency localization control FIR filters 18*a* through 18*d* shown in FIG. 7. Thus, both the crew members L1 and L2 perceive localization of the low frequency component of the R-channel signal in the direction of the speaker 23 shown in FIG. 9, i.e., in the direction of +60 degrees.

Next, a localization control operation on a high frequency component will be described.

Figure 1:
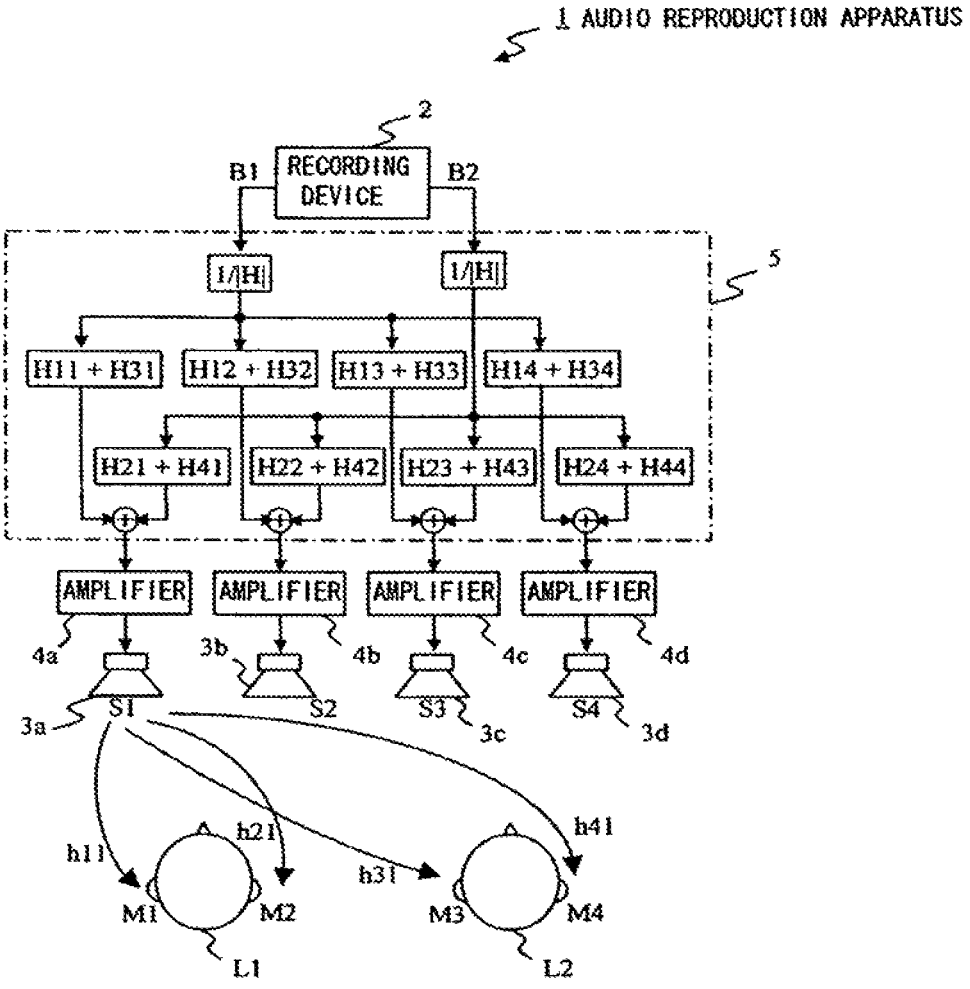
FIG. 1 PRIOR ART
FIG. 1 shows a conventional audio reproduction apparatus.
Figure 2:
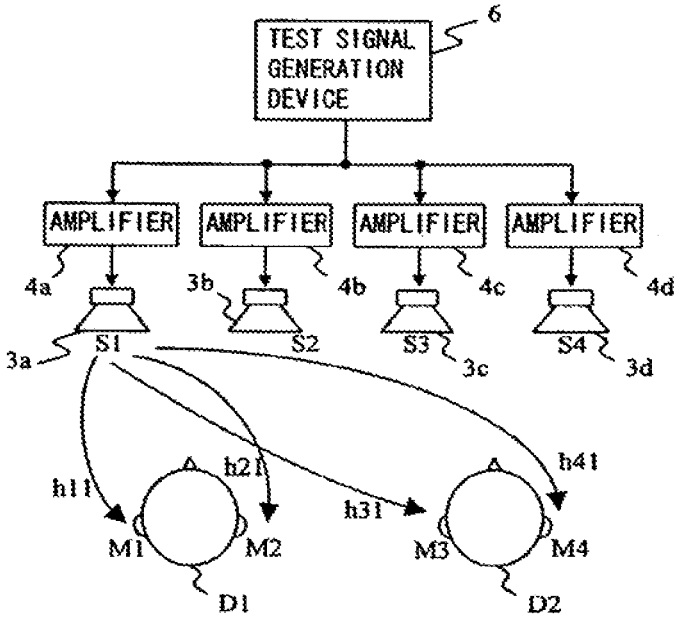
FIG. 2 PRIOR ART
FIG. 2 shows a method for measuring transfer functions.
Figure 3:
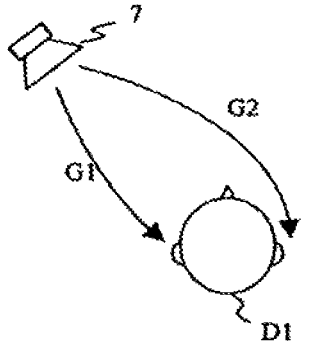
FIG. 3 PRIOR ART
FIG. 3 shows target transfer functions.
Figure 4:
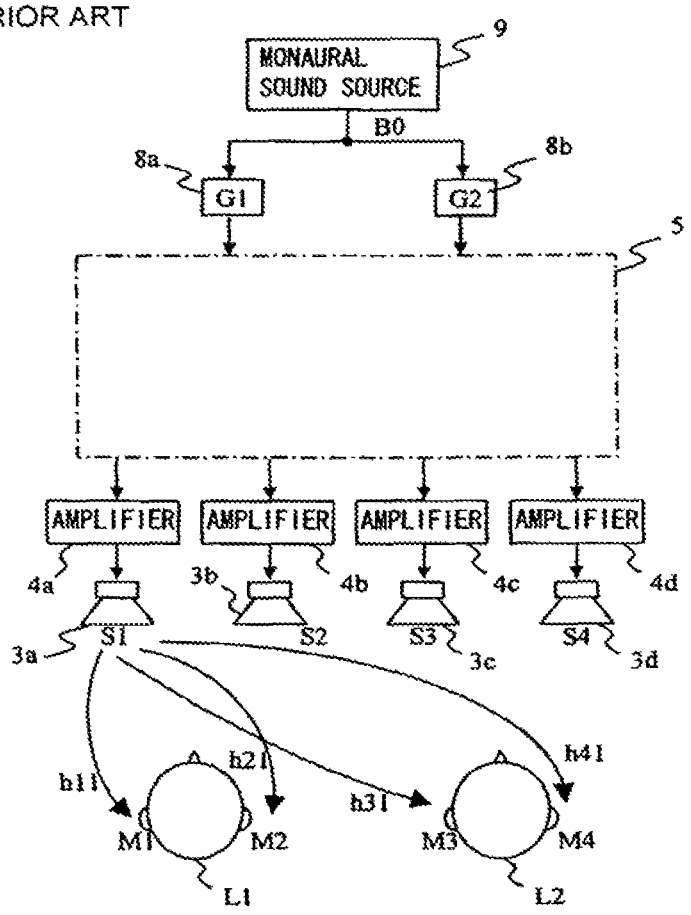
FIG. 4 PRIOR ART
FIG. 4 shows a structure for executing sound image localization control using a conventional audio reproduction apparatus.
Figure 5:
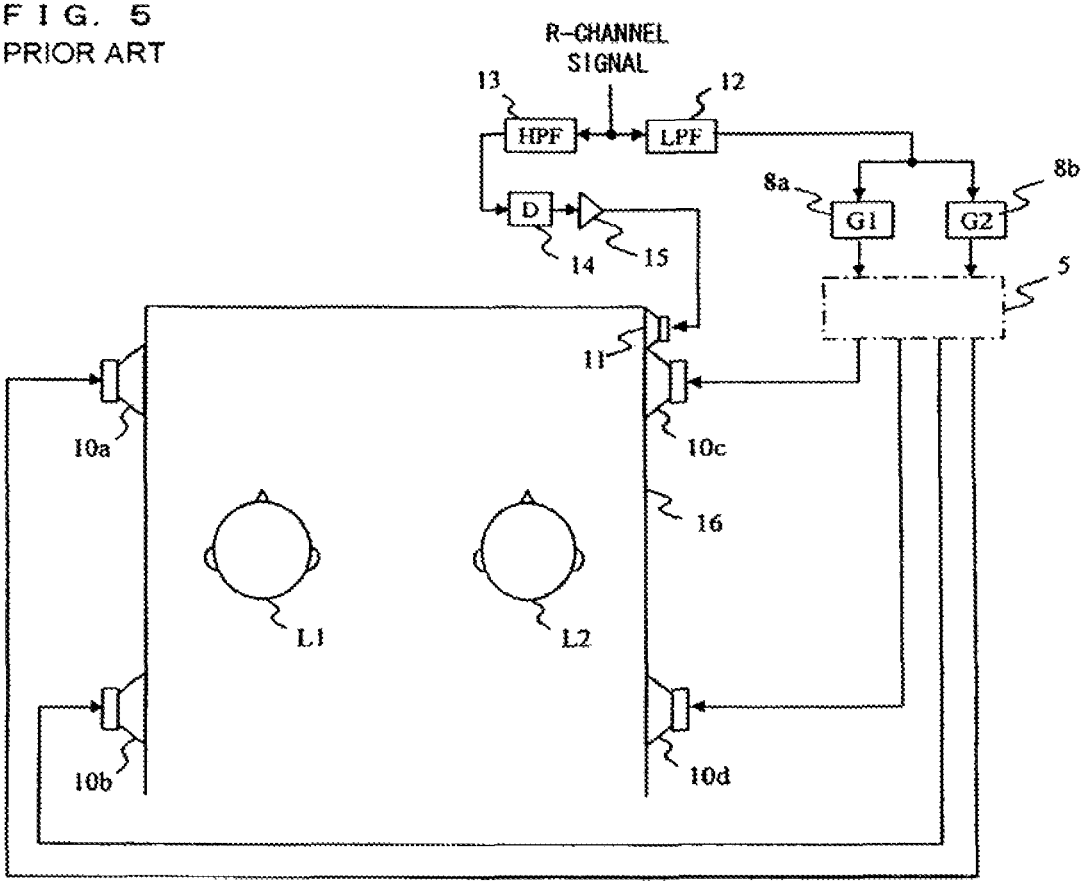
FIG. 5 PRIOR ART
FIG. 5 shows a structure for executing sound image localization control using a conventional audio reproduction apparatus in a vehicle with the frequency band being divided.
Figure 6:
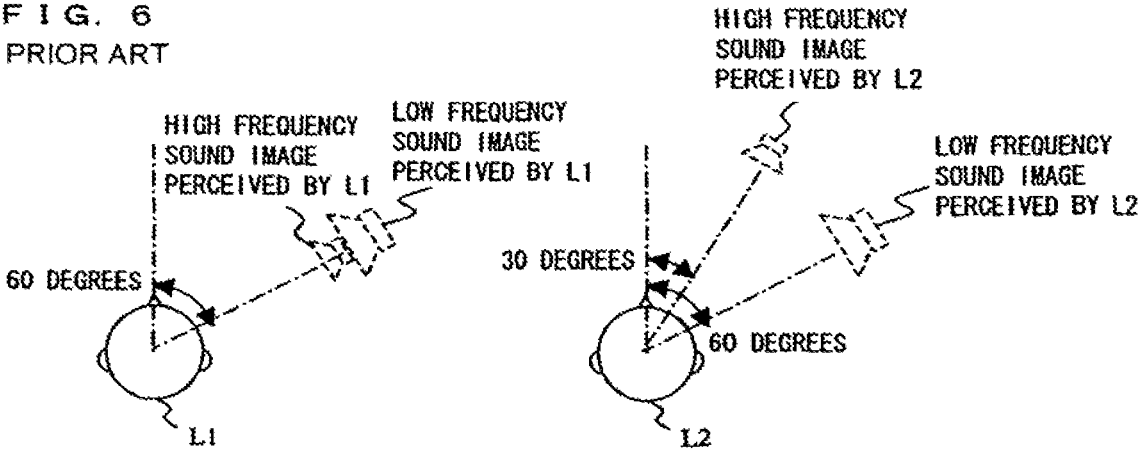
FIG. 6 PRIOR ART
FIG. 6 shows sound image localization directions in the structure shown in FIG. 5.
Figure 11:
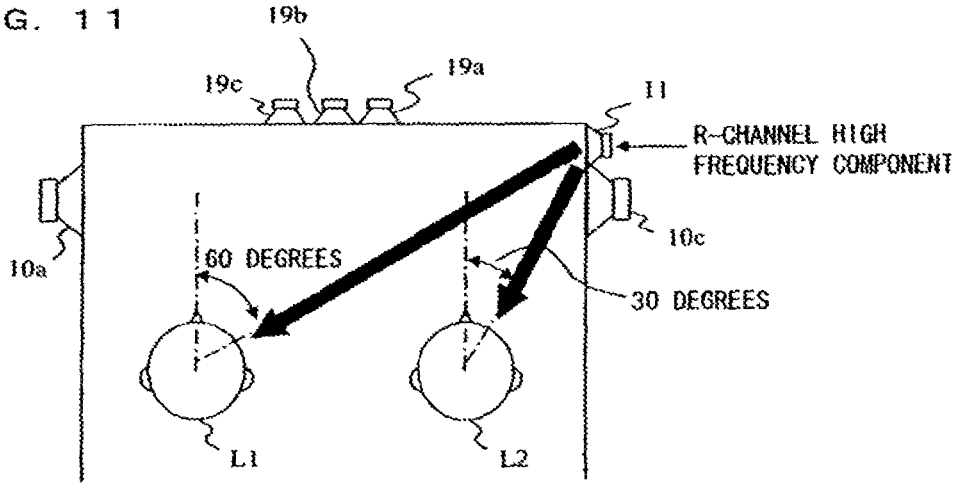
FIG. 11 shows sound image localization directions when only a high frequency reproduction speaker is driven in the vehicle-mountable sound image localization control apparatus according to the first embodiment of the present invention.
Figure 12A:
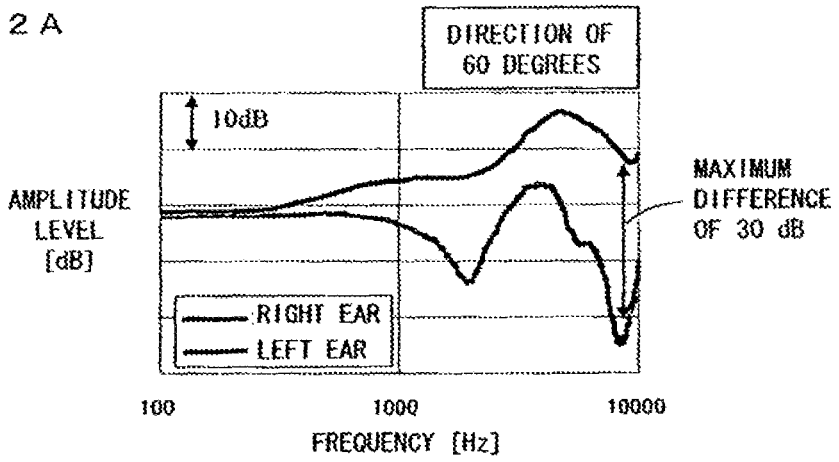
FIG. 12A shows the amplitude level of a head-related acoustic transfer function in the direction of 60 degrees.
Figure 12B:
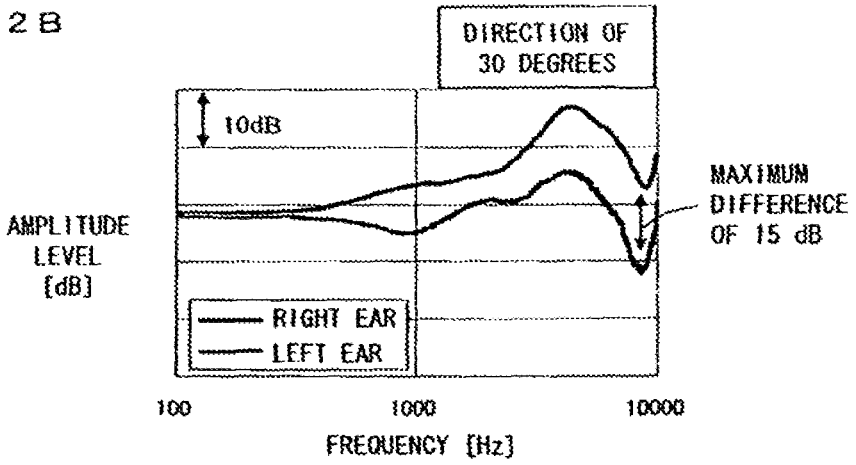
FIG. 12B shows the amplitude level of a head-related acoustic transfer function in the direction of 30 degrees.
Figure 13:
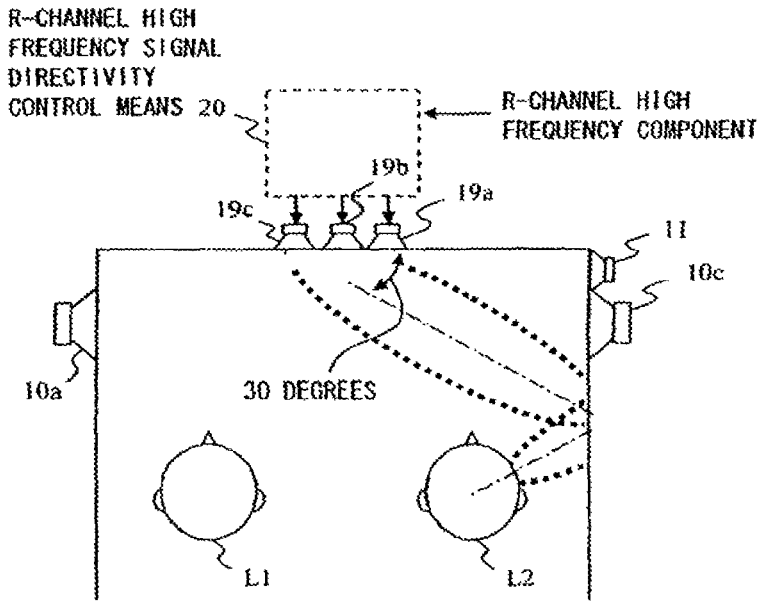
FIG. 13 shows a direction in which a reflected sound comes when only a high frequency reproduction speaker array is driven in the vehicle-mountable sound image localization control apparatus according to the first embodiment of the present invention.

In FIG. 7, an output from the high pass filter 13 is input to the delay device 14*d*. The output from the high pass filter 13 is also input to, and processed by, the R-channel high frequency signal directivity control means 20, and is output from the high frequency reproduction speaker array (speakers 19*a* through 19*c*). The R-channel high frequency signal directivity control means 20 executes signal processing such that the outputs from the high frequency reproduction speaker array (speakers 19*a* through 19*c*) have a directivity characteristic in the direction of −60 degrees rearward in the vehicle, i.e., toward the glass door to the right of the crew member L2. The high frequency reproduction speaker 11 outputs a high frequency component having a phase and a gain matched to those of the low frequency component by the delay device 14*d* and the gain device 15*d*. In the case where the R-channel high frequency component is reproduced only from the high frequency reproduction speaker 11, the sound image is localized as follows. As shown in FIG. 11, for the crew member L1, the sound image is localized in the direction of +60 degrees in which the high frequency reproduction speaker 11 exists. For the crew member L2, the sound image is localized in the direction of +30 degrees in which the high frequency reproduction speaker 11 exists. This occurs because of the positional relationship between the seats and the door pillar in a general vehicle having two seats on one row as described regarding the prior art with reference to FIG. 6. The sound pressure level at both ears of the crew members L1 and L2 are close to the high frequency band characteristic of the amplitude level of the head-related acoustic transfer function in the directions of +60 degrees and +30 degrees. FIG. 12A and FIG. 12 show the head-related acoustic transfer functions. As shown in FIG. 12A, for the crew member L1, the interaural amplitude level difference is about 30 dB at the maximum in the high frequency band. As shown in FIG. 12B, for the crew member L2, the interaural amplitude level difference is about 15 dB even at the maximum. In the case where the R-channel high frequency component having a directivity in the direction of 60 degrees toward the right glass door (i.e., in the direction of −60 degrees) is reproduced only from the high frequency reproduction speaker array (speakers 19*a* through 19*c*) located at the center of the dashboard, the sound image is localized as follows. As shown in FIG. 13, the crew member L2 listens to a reproduction sound from the high frequency reproduction speaker array (speakers 19*a* through 19*c*) which is reflected by the glass door, because of the positional relationship among the dashboard, the front glass door and the crew member L2 in a general vehicle. As a result, the crew member L2 perceives the sound image in the direction of +60 degrees. It is clear from the known technology that the direction of directivity is adjustable by the delay devices 14*a* through 14*c* and the acuteness of the directivity beam is adjustable by the gain devices 15*a* through 15*c*. For example, for providing a directivity characteristic of a degrees, the delay value of the delay devices 14*a* through 14*c* is set such that the difference between the delay devices 14*a* and 14*b* and the difference between the delay devices 14*b* and 14*c* is:

$$\Delta = l \cdot \sin \alpha c, \qquad \text{[Expression 23]}$$

where the interval between the speakers 19*a* through 19*c* of the high frequency reproduction speaker array is d and the sonic speed is c. For the gain devices 15*a* through 15*c*, an identical gain is set. Alternatively, the gain may be set based on a coefficient distribution such as Tschebyscheff array or the like. It is necessary to make an adjustment so as to provide the gain with an offset value, such that the high frequency component listened to by the crew member L2 after being reflected by the glass door to the right of the crew member L2, is not so different in terms of gain or phase from the high frequency component coming from the high frequency production speaker 11 or the low frequency components coming from the low frequency reproduction speakers 10*a* through 10*d*. The reflected sound also reaches the crew member L1, but the level of the sound reaching the crew member L1 is significantly lower than that of the sound listened to by the crew member L2 because the sound is attenuated by the distance and the crew member L2 acts as an obstacle. Therefore, as shown in FIG. 7, when the R-channel high frequency component is reproduced at the same time from the high frequency reproduction speaker 11 and the high frequency reproduction speaker array (speakers 19*a* through 19*c*), the crew member L1 perceives localization of the sound image of the high frequency component in the direction of +60 degrees. The reason is that the reproduction sound from the high frequency reproduction speaker 11 is dominant around the crew member L1. The crewmember L2 listens to a synthesized sound of the reproduction sound from the high frequency reproduction speaker 11 and the reproduction sound from the high frequency reproduction speaker array (speakers 19*a* through 19*c*). Especially in the high frequency band, it is believed that a human perceives a direction of the sound image using the interaural amplitude level difference, not an interaural phase difference. Therefore, when the synthesis of the reproduction sounds raises the sound pressure level at the right ear and thus increases the interaural amplitude level difference as compared to that in FIG. 12B, the crew member L2 can perceive localization of the sound image in the direction of about +60 degrees.

By the operation described so far, the interaural amplitude level differences of the crew members L1 and L2 located in the front seats of the vehicle 16 become equal. As a result, both the crew members L1 and L2 perceive localization of the sound image of the R-channel signal of the audio signal at a desired direction over the entire frequency band. The expression that "the interaural amplitude level differences are equal" does not necessarily mean that the interaural amplitude level differences are precisely equal to each other, but means that the interaural amplitude level differences of the crew members L1 and L2 are sufficiently close to each other to allow the crew members L1 and L2 to perceive the sound image in the same direction. For example, for realizing sound image localization in the direction of 60 degrees, when the interaural amplitude level difference is smaller than the ideal value by 10 dB or greater at or around 2 kHz or 8 kHz, the sound image in the direction of 60 degrees is indistinguishable from the sound image in the direction of 30 degrees. Therefore, for realizing sound image localization in the direction of 60 degrees using a speaker installed in the direction of 30 degrees, it is desired that the difference (error) between the interaural amplitude level difference of the crew member L1 and the interaural amplitude level difference of the crew member L2 is restricted to at least about 10 dB. Needless to say, the error needs to be as small as possible for realizing highly precise sound image localization. According to a general hearing ability of a human, sound image localization in a side direction is more difficult to be identified than sound image localization in a forward direction. Therefore, sound image localization in a side direction has a larger tolerance than sound image localization in a forward direction. The difference between the interaural amplitude level difference of the crew member L1 and the interaural amplitude level difference of the crew member L2 can be controlled with high precision using reflection by a glass door having a low sound wave absorbance.

Figure 14:
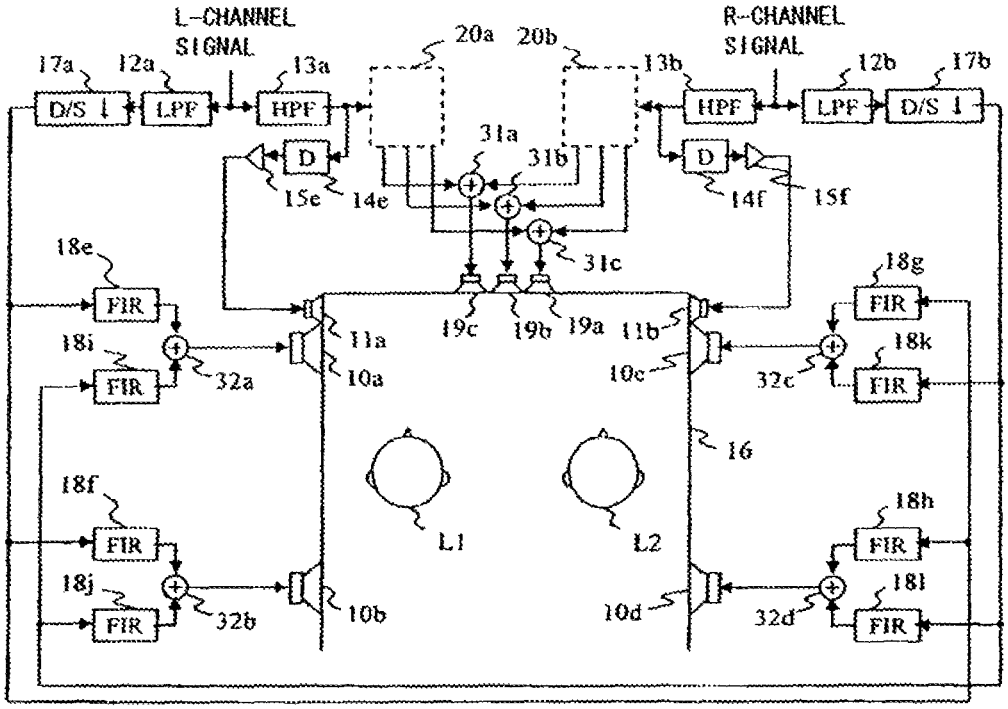
FIG. 14 shows a vehicle-mountable sound image localization control apparatus for executing sound image localization control on an L-channel signal and an R-channel signal at the same time in the first embodiment of the present invention.

FIG. 7 shows a structure for executing sound image localization control on an R-channel signal. Sound image localization of signals of other channels such as an L-channel signal can be performed by substantially the same structure. FIG. 14 shows a structure for executing sound image localization control on an L-channel signal and an R-channel signal at the same time. In FIG. 14, reference numerals 10*a* through 10*d* represent low frequency reproduction speakers for an L-channel signal and an R-channel signal, which are attached to doors; reference numerals 12*a* and 12*b* respectively represent low pass filters for extracting a low frequency component of an L-channel signal and an R-channel signal; reference numerals 13*a* and 13*b* respectively represent high pass filters for extracting a high frequency component of the L-channel signal and the R-channel signal; reference numerals 14*e* and 14*f* represent delay devices; reference numerals 15*e* and 15*f* represent gain devices; reference numeral 16 represents a vehicle on which the vehicle-mountable sound image localization control apparatus is mounted; reference numerals 17*a* and 17*b* represent downsampling converters; reference numerals 18*e* through 18*h* represent low frequency localization control FIR filters for an L-channel signal; reference numerals 18*i* through 18*l* represent low frequency localization control FIR filters for an R-channel signal; reference numeral 19*a* through 19*c* represent speakers in a high frequency reproduction speaker array for an L-channel signal and an R-channel signal, which are attached at the center of a dashboard at an equal interval; reference numeral 20*a* represents L-channel high frequency signal directivity control means; reference numeral 20*b* represents R-channel high frequency signal directivity control means; reference numerals 31*a* through 31*c* represent adders for adding an output from the L-channel high frequency signal directivity control means 20*a* and an output from the R-channel high frequency signal directivity control means 20*b*; reference numerals 32*a* through 32*d* are adders respectively for adding outputs from the low frequency localization control FIR filters 18*e* through 18*h* for the L-channel signal and outputs from the low frequency localization control FIR filters 18*i* through 18*l* for the R-channel signal.

In the structure of FIG. 14, the sound image localization control operation on the R-channel signal is the same as that of the vehicle-mountable sound image localization control apparatus shown in FIG. 7 and will be omitted here. The sound image localization control operation on the L-channel signal is the same except for the following. For measuring the target function functions, the speaker 23 (FIG. 9) is set in the direction of −60 degrees. The delay devices and the gain devices included in the L-channel high frequency signal directivity control means 20*a* are adjusted, such that when the output therefrom is reproduced by the high frequency reproduction speaker array (speakers 19*a* through 19*c*), the reproduction sound has a directivity characteristic in the direction of +60 degrees. An L-channel high frequency signal, the directivity of which is not controlled, is reproduced from a high frequency reproduction speaker 11*a*. For the low frequency component, an L-channel component and an R-channel component are added together by the adders 32*a* through 32*d* and reproduced from the low frequency reproduction speakers 10*a* through 10*d*. For the high frequency component, an L-channel component and an R-channel component are added together by the adders 31*a* through 31*d* and reproduced from the high frequency reproduction speaker array (speakers 19*a* through 19*c*). By the operation described so far, both the crew members L1 and L2 located in the front seats of the vehicle 16 perceive localization of the sound image of each of the L-channel signal and the R-channel signal at a desired direction over the entire frequency band. For localizing the sound image behind the crew members L1 and L2 with, for example, a surround L-channel or surround R-channel system, a high frequency reproduction speaker array is attached rearward to the seats of the crew members L1 and L2, and the directivity is controlled such that the crew members L1 and L2 listen to the reflected sound from a desired direction.

In the structure of FIG. 14, the high frequency reproduction speaker array (speakers 19*a* through 19*c*) is attached at the center of the dashboard. Such a structure realizes a high frequency reproduction speaker array required to radiate an R-channel high frequency signal toward the glass door to the right of the crew member L2, and a high frequency reproduction speaker array required to radiate an L-channel high frequency signal toward the glass door to the left of the crew member L1, with a common high frequency reproduction speaker array. This provides the vehicle-mountable sound image localization control apparatus at lower cost and saves the space in the vehicle. Such an effect is also obtained by installing the high reproduction speaker array (speakers 19*a* through 19*c*) on the central axis of the vehicle (at a position equidistant from the crew members L1 and L2) instead of at the center of the dashboard.

Figure 15:
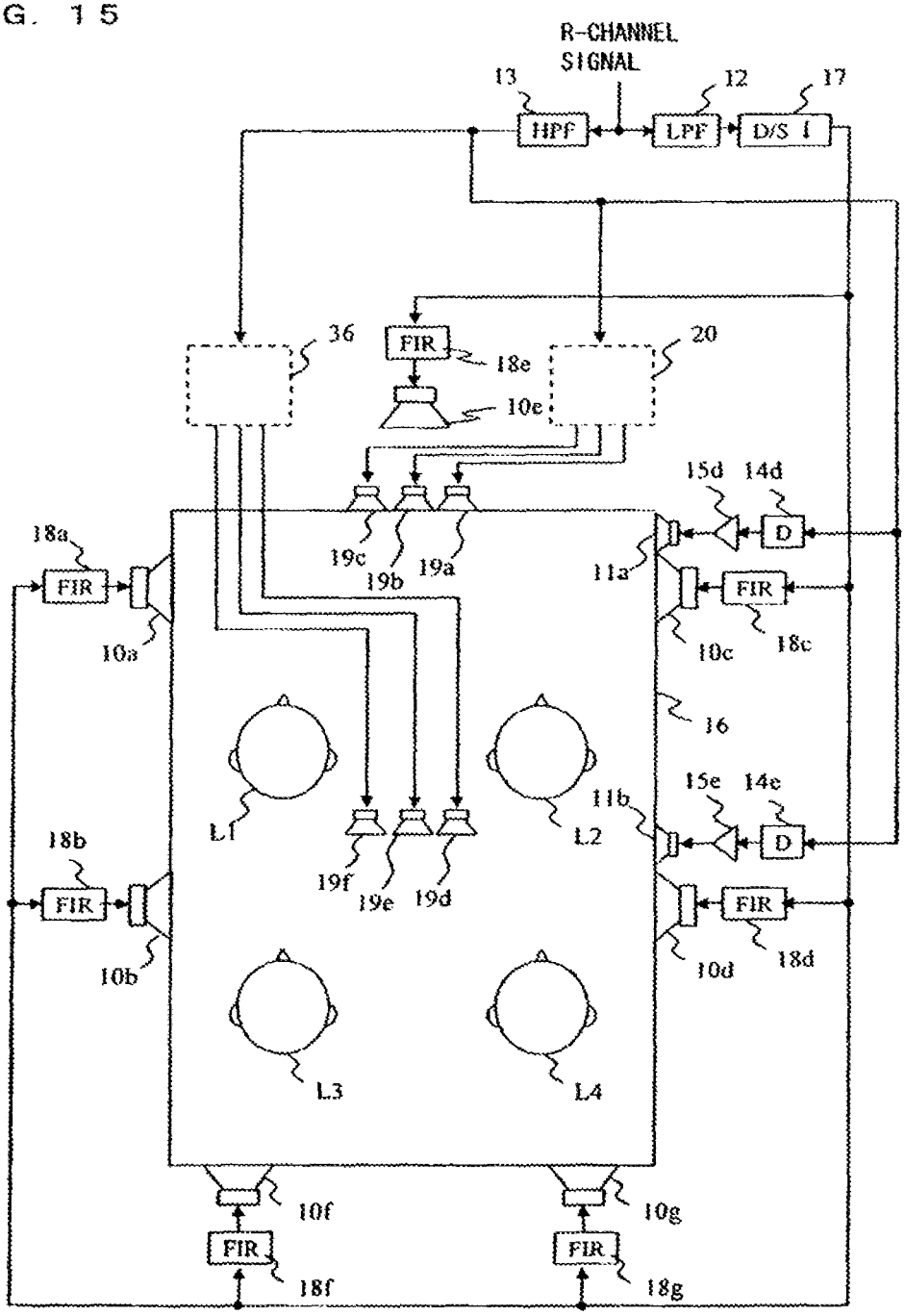
FIG. 15 shows a structure for executing sound image localization control on an R-channel high frequency component for crew members in front seats and crew members in rear seats in the vehicle-mountable sound image localization control apparatus according to the first embodiment of the present invention.
Figure 16:
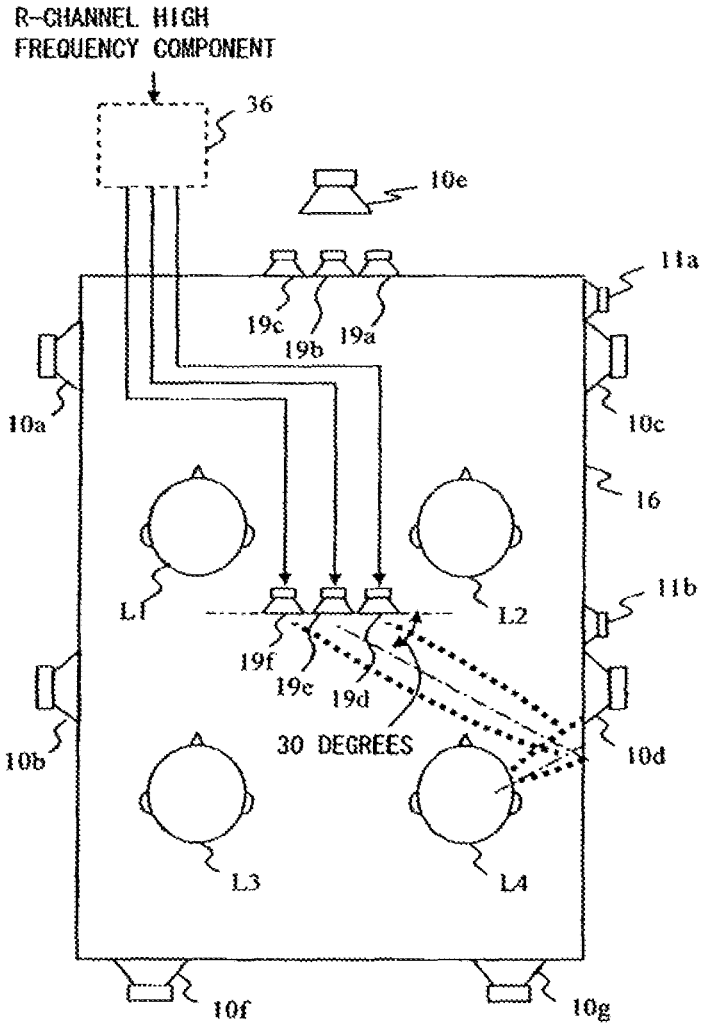
FIG. 16 shows a direction in which a reflected sound comes when only a high frequency reproduction speaker array attached to an armrest is driven in the vehicle-mountable sound image localization control apparatus according to the first embodiment of the present invention.

The vehicle-mountable sound image control apparatus shown in FIG. 7 has a structure for allowing crew members located in front seats of the vehicle 16 to perceive localization of a sound image in a desired direction. For allowing crew members positioned in rear seats to perceive localization of a sound image in a desired direction, the following structure can be used. As shown in FIG. 15, a high frequency reproduction speaker 11*b* is attached to a rear door pillar, and a high frequency reproduction speaker array (speakers 19*d* through 19*f*) is attached, for example, behind the armrest between the front seats or on the ceiling. With such a structure, the crew members L1 and L2 located in the front seats and crew members L3 and L4 located in the rear seats can perceive localization of a sound image in a desired direction at the same time. In FIG. 15, reference numeral 10*e* represents a low frequency reproduction speaker attached at or around the center of the dashboard, and reference numerals 10*f* and 10*g* represent low frequency reproduction speakers attached in rear trays. Reference numeral 11*b* represents the high frequency reproduction speaker attached to the rear door pillar on the side of the crew member L4. The crew member L3 perceives localization of a reproduction sound from the high frequency reproduction speaker 11*b* in the direction of 60 degrees on the right, and the crew member L4 perceives localization of the reproduction sound from the high frequency reproduction speaker 11*b* in the direction of 30 degrees on the right. Reference numerals 18*e* through 18*g* represent low frequency localization control FIR filters respectively connected to the low frequency reproduction speakers 10*e* through 10*g*. For each of the low frequency localization control FIR filters 18*e* through 18*g*, a coefficient designed by an adaptive filter or other techniques described above with reference to FIG. 10 is set such that the crew members L1 through L4 perceive localization of a low frequency component at the same time. Reference numerals 19*d* through 19*f* represent speakers of a high frequency reproduction speaker array attached behind the armrest such that the vibration surfaces thereof are directed to the rear seats. Reference numeral 36 represents rear seat R-channel high frequency signal directivity control means, which executes directivity control processing such that an R-channel high frequency component has a directivity of being radiated from the high frequency reproduction speaker array (speakers 19*d* through 19*f*) in the direction of about 60 degrees toward the glass door to the right of the crew member L4 (i.e., in the direction of −60 degrees). Reference numeral 14*e* represents a delay device for delaying the R-channel high frequency component by a predetermined time period, and reference numeral 15*e* represents a gain device for adjusting the amplitude of the output from the delay device 14*e*. The gain device 15*e* is set so as to match the phases and gains of the high frequency component and the low frequency component. Other elements shown in FIG. 15 operate in an identical manner to those shown in FIG. 7 and bear identical reference numerals thereto. FIG. 16 shows sound reflection of an R-channel high frequency component reproduced by the high frequency reproduction speaker array (speakers 19*d* through 19*f*). Because of the positional relationship among the armrest, the rear glass door and the crew member L4 in a general vehicle, the crew member L4 listens to the reproduction sound from the high frequency reproduction speaker array (speakers 19*d* through 19*f*) which is reflected by the glass door. As a result, the crew member L4 perceives the sound image in the direction of +60 degrees. The crewmember L4 listens to a synthesized sound of the reproduction sound from the high frequency reproduction speaker 11*b* and the reproduction sound from the high frequency reproduction speaker array (speakers 19*d* through 19*f*), and as a result, perceives localization of the high frequency component of the R-channel signal in a direction close to the direction of +60 degrees. The reproduction sound from the high frequency reproduction speaker array (speakers 19*d* through 19*f*) which reaches the crew member L3 is a reflected sound of a very low level, and therefore, the crew member L3 only listens to the reproduction sound from the high frequency reproduction speaker 11*b*. As a result, the crew member L3 perceives localization of the sound image in the direction of +60 degrees. The reproduction sound from the high frequency reproduction speaker array (speakers 19*d* through 19*f*) and the reproduction sound from the high frequency reproduction speaker 11*b* have a directivity characteristic rearward in the vehicle, and therefore hardly reaches the crew members L1 and L2 in the front seats. Therefore, the perception by the crew members L1 and L2 of the localization of the R-channel high frequency component obtained by synthesizing the reproduction sound from the high frequency reproduction speaker array (speakers 19*a* through 19*c*) and the reproduction sound from the high frequency reproduction speaker 11*a* is not spoiled. The reproduction sound from the high frequency reproduction speaker array (speakers 19*a* through 19*c*), and the reproduction sound from the high frequency reproduction speaker 11*a*, reach the rear seats at a low level because the sounds are attenuated by the distance and the front seats act as an obstacle. Therefore, the perception by the crew members L3 and L4 of the localization of the R-channel high frequency component is not spoiled. Thus, the structure shown in FIG. 15 allows the crew members L1 and L2 in the front seats and the crew members L3 and L4 in the rear seats to perceive localization of a sound image of the R-channel high frequency component in the direction of +60 degrees at the same time.

The vehicle-mountable sound image localization control apparatus shown in FIG. 7 uses three speaker units 19*a* through 19*c* as the high frequency reproduction speaker array, but the number of the speakers is not limited to three. For improving the acuteness of the directivity characteristic, it is preferable to increase the number of speakers included in the high frequency reproduction speaker array. Needless to say, the number of the delay devices and the number of the gain devices included in the R-channel high frequency signal directivity control means 20 are increased or decreased in accordance with the number of the speaker units included in the high frequency reproduction speaker array.

The vehicle-mountable sound image localization control apparatus shown in FIG. 7 has a structure for reproducing a high frequency component from the high frequency reproduction speaker 11 attached to the door pillar. The high frequency component may be reproduced only from the high frequency reproduction speaker array (speakers 19*a* through 19*c*) with the high frequency reproduction speaker 11 being omitted. In such a case, for the crewmember L1, the gain of the high frequency component is decreased and the direction of localization is slightly offset from the direction of 60 degrees, but the cost of the speakers can be reduced.

Figure 17:
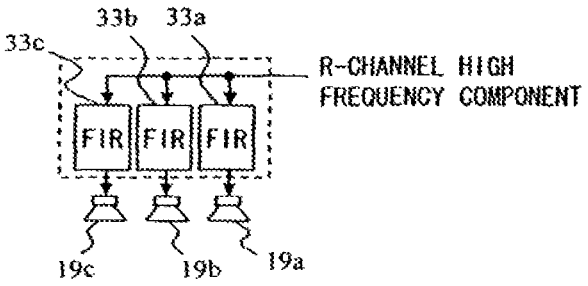
FIG. 17 shows a structure for using FIR filters as directivity control means.

In the vehicle-mountable sound image localization control apparatus shown in FIG. 7, the R-channel high frequency signal directivity control means 20 includes delay devices and gain devices. The present invention is not limited to such a structure. For example, as shown in FIG. 17, the delay devices and the gain devices may be replaced with FIR filters 33*a* through 33*c*. In such a case, the calculation processing is increased, but an acute directivity is realized over a wider frequency band.

Second Embodiment

Figure 18:
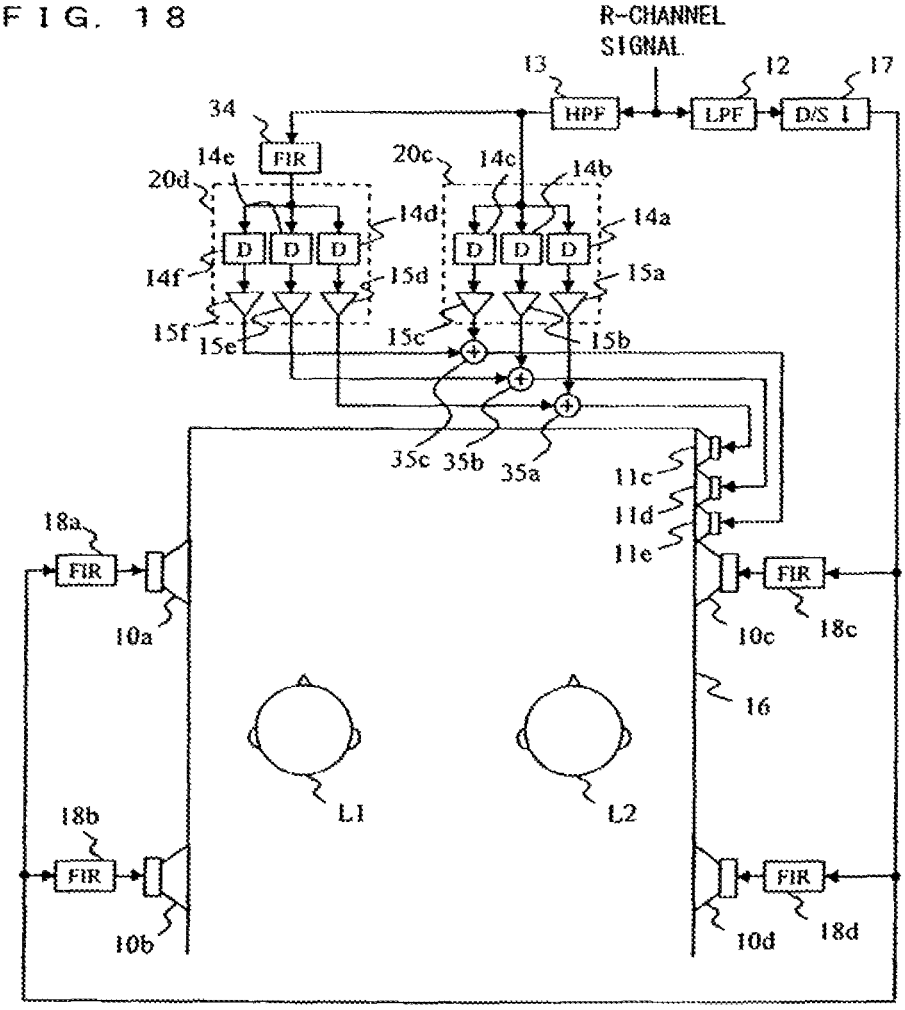
FIG. 18 shows a vehicle-mountable sound image localization control apparatus according to a second embodiment of the present invention.

FIG. 18 shows a vehicle-mountable sound image localization control apparatus according to a second embodiment. The vehicle-mountable sound image localization control apparatus shown in FIG. 18 allows both the crew members L1 and L2 located in front seats of the vehicle 16 to perceive localization of a sound image of an R-channel signal of an audio signal in a desired direction over the entire frequency band. Specifically, in the following description, it is assumed that the vehicle-mountable sound image localization control apparatus is operated for the purpose of localizing an R sound source in the direction of 60 degrees on the right like the vehicle-mountable sound image localization control apparatus in the first embodiment.

In FIG. 18, reference numerals 11*c* through 11*e* represent speakers of a high frequency reproduction speaker array attached to a front door pillar; reference numerals 14*a* through 14*f* represent delay devices; reference numeral 15*a* through 15*f* represent gain devices; reference numeral 20*c* represents first R-channel high frequency signal directivity control means including the delay devices 14*a* through 14*c* and the gain devices 15*a* through 15*c*; reference numeral 20*d* represents second R-channel high frequency signal directivity control means including the delay devices 14*d* through 14*f* and the gain devices 15*d* through 15*f*; reference numeral 34 represents a linear phase FIR filter for processing an R-channel high frequency component; and reference numerals 35*a* through 35*c* represent adders for adding an output from the first R-channel high frequency signal directivity control means 20*c* and an output from the second R-channel high frequency signal directivity control means 20*d* and respectively inputting the addition result to the speakers 11*c* through 11*e* of the high frequency reproduction speaker array. The other elements shown in FIG. 18 operate in an identical manner to those shown in FIG. 7 and bear identical reference numerals thereto. The localization control operation performed by the vehicle-mountable sound image localization control apparatus shown in FIG. 18 on a low frequency component is the same as that of the vehicle-mountable sound image localization control apparatus shown in FIG. 7 and will be omitted. Hereinafter, a localization control operation performed on a high frequency component will be described.

Figure 19:
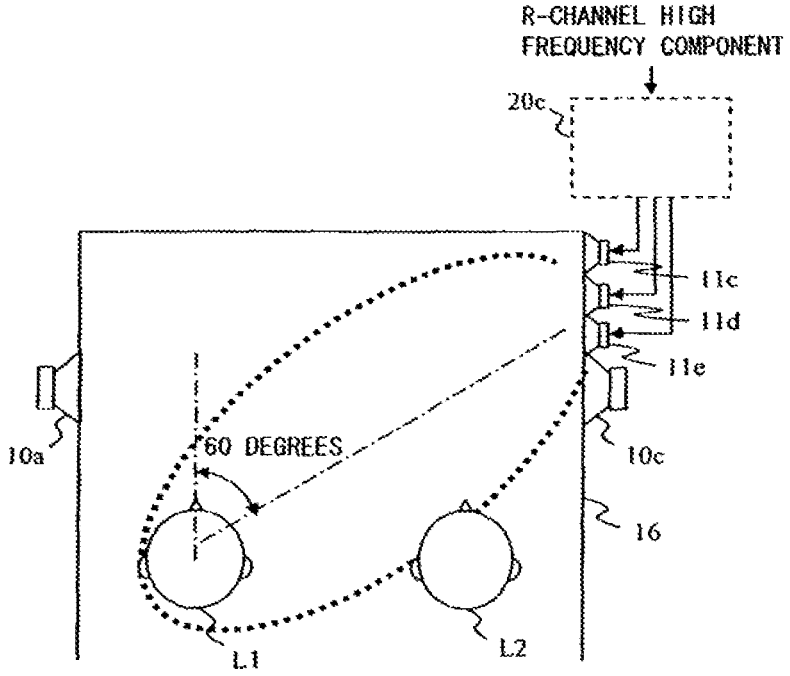
FIG. 19 shows a directivity characteristic of an output component from first R-channel high frequency signal directivity control means in the vehicle-mountable sound image localization control apparatus according to the second embodiment of the present invention.

FIG. 19 shows a directivity characteristic when only an output from the first R-channel high frequency signal directivity control means 20*c* is reproduced from the high frequency reproduction speaker array (speakers 11*c* through 11*e*). The delay devices and the gain devices included in the first R-channel high frequency signal directivity control means 20*c* are adjusted such that the R-channel high frequency component has a main lobe in the direction of 30 degrees on the left (i.e., −30 degrees), where the front face of the high frequency reproduction speaker array (speakers 11*c* through 11*e*) is aligned in the direction of 0 degrees and that no sound is radiated toward the right ear of the crew member L2. As a result, the crew member L2 perceives localization of a sound image of the R-channel high frequency component in the direction of +60 degrees. The crew member L2 listens to the R-channel high frequency component with his/her left ear but can listen to the R-channel high frequency component at a very low level with his/her right ear.

Figure 20:
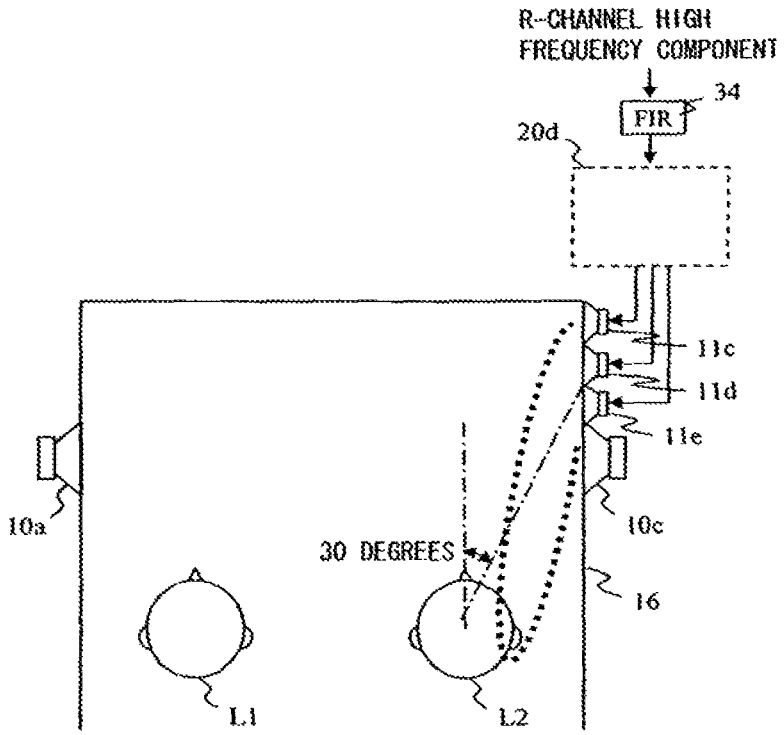
FIG. 20 shows a directivity characteristic of an output component from second R-channel high frequency signal directivity control means in the vehicle-mountable sound image localization control apparatus according to the second embodiment of the present invention.

FIG. 20 shows a directivity characteristic when only an output from the second R-channel high frequency signal directivity control means 20*d* is reproduced from the high frequency reproduction speaker array (speakers 11*c* through 11*e*). The delay devices and the gain devices included in the second R-channel high frequency signal directivity control means 20*d* are adjusted such that the R-channel high frequency component has a directivity only in the direction generally toward the right ear of the crew member L2. As a result, the crew member L1 can hardly listen to the R-channel high frequency component. The crew member L2 listens to the R-channel high frequency component processed by the FIR filter 34 from the high frequency reproduction speaker array (speakers 11*c* through 11*e*), which is positioned in the direction of about +30 degrees with respect to the crew member L2 only with his/her right ear.

Figure 21:
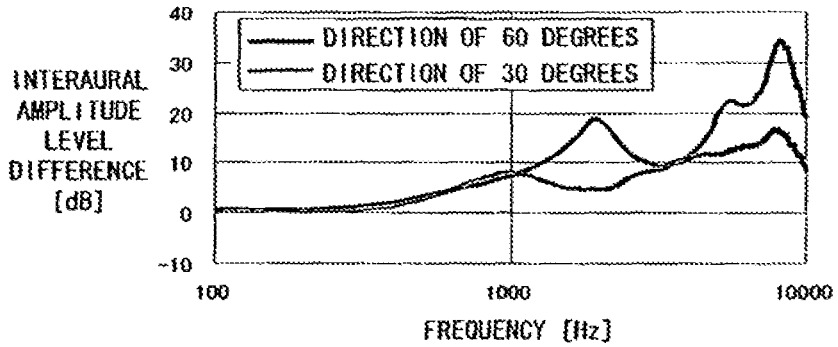
FIG. 21 shows an interaural amplitude level difference of a head-related acoustic transfer function in the direction of 60 degrees and the direction of 30 degrees.

Next, coefficient design of the FIR filter 34 will be described. FIG. 21 shows the interaural amplitude level difference of the head-related acoustic transfer function regarding the direction of 60 degrees and the direction of 30 degrees (a difference characteristic obtained by subtracting the characteristic at the ear at which the amplitude level is lower from the characteristic at the ear at which the amplitude level is higher). As is clear from FIG. 21, in the direction of 60 degrees, the interaural amplitude level difference becomes significantly larger at or around 2 kHz and 8 kHz. Using this, the amplitude level of the sound reaching the right ear (or the left ear) is compensated, such that the difference between the amplitude level of the sound reaching the left ear of the listener and the amplitude level of the sound reaching the right ear of the listener matches the frequency characteristic of the interaural amplitude level difference in the direction of 60 degrees shown in FIG. 21. Thus, the listener is allowed to perceive localization of a sound image in the direction of 60 degrees. Namely, the crew member L2 perceives localization of a sound image in the direction of +60 degrees in the case where a coefficient for realizing the above-mentioned compensation is set for the FIR filter 34 in the structure shown in FIG. 20 and an R-channel high frequency component which is not processed by the FIR filter 34 as shown FIG. 19 is supplied to the left ear of the crew member L2. It should be noted that the interaural amplitude level difference shown in FIG. 21 is obtained as a result of measuring the head-related acoustic transfer function of a sound source in the direction of 30 degrees and a sound source in the direction of 60 degrees using a dummy head in an acoustic characteristic measuring environment such as an anechoic chamber. The head-related acoustic transfer function is varied, for example, when the high frequency reproduction speaker array (speakers 11*c* through 11*e*) is positioned in a direction other than the direction of 30 degrees or when there is an influence of the reflected sound in the vehicle. The head-related acoustic transfer function is also varied by the shape of the head of the crew member L2 or the height of the crew member L2 when sitting on the seat. Accordingly, a compensation coefficient for realizing more precise sound image localization control is obtained in the case where the head-related acoustic transfer function is measured while a crew member actually using the vehicle-mountable sound image localization control apparatus sits on the seat and thus the interaural amplitude level difference is calculated. Alternatively, input means for inputting an instruction from a listener (the crew member L1 or L2) may be provided in the vehicle-mountable sound image localization control apparatus, so that the coefficient of the FIR filter 34 may be appropriately changed in accordance with the instruction which is input through the input means. As means for compensating the frequency characteristic, a linear phase FIR filter having a constant group delay is usable. By supplying the constant group delay to the delay devices 14*a* through 14*c* included in the first R-channel high frequency signal directivity control means 20*c* as an offset, the phase offset in the output component from the first R-channel high frequency signal directivity control means 20*c* can be eliminated. As means for compensating the frequency characteristic, an IIR filter is usable instead of the FIR filter 34. In this case, the crew member L2 perceives a phase difference between the ears and obtains a sense of unnaturalness, but the calculation processing amount can be decreased.

As is appreciated from FIG. 21, there is an interaural amplitude level difference also in the direction of 30 degrees. Therefore, the localization effect can be improved by providing the FIR filter 34 with a characteristic corresponding to a difference between the interaural amplitude level difference in the direction of 60 degrees and the interaural amplitude level difference in the direction of 30 degrees. Specifically, the FIR filter 34 is provided with a characteristic such that a sound at or around 2 kHz and 8 kHz, where the interaural amplitude level difference in the direction of 60 degrees is significantly different from the interaural amplitude level difference in the direction of 30 degrees, is increased when being output, and that a sound at or around 4 kHz, where the interaural amplitude level difference in the direction of 60 degrees is generally the same as the interaural amplitude level difference in the direction of 30 degrees, is output without being increased.

The first R-channel high frequency signal directivity control means 20*c* may be omitted. In this case, the sound listened to by both ears of the crew member L1 and the left ear of the crew member L2 reaches the right ear of the crew member L2. That sound and the output sound from the second R-channel high frequency signal directivity control means 20*d* interfere with each other. The FIR filter 34 is designed such that the characteristic of the interfering sound matches the characteristic of the interaural amplitude level difference regarding the sound source in the direction of 60 degrees shown in FIG. 21.

For executing sound image localization control on an L-channel signal, the high frequency reproduction speaker array (speakers 11*c* through 11*e*) is attached to the left front door. Then, the delay devices and the gain devices included in the first R-channel high frequency signal directivity control means 20*c* are set such that an output therefrom has a directivity of having a main lobe in the direction of 30 degrees on the right, where the front face of the high frequency reproduction speaker array (speakers 11*c* through 11*e*) is aligned in the direction of 0 degrees, and radiating no sound toward the left ear of the crew member L1. The delay devices and the gain devices included in the second R-channel high frequency signal directivity control means 20*d* are set such that an output therefrom has a directivity characteristic only in the direction generally toward the left ear of the crew member L1 from the high frequency reproduction speaker array (speakers 11*c* through 11*e*).

Figure 22:
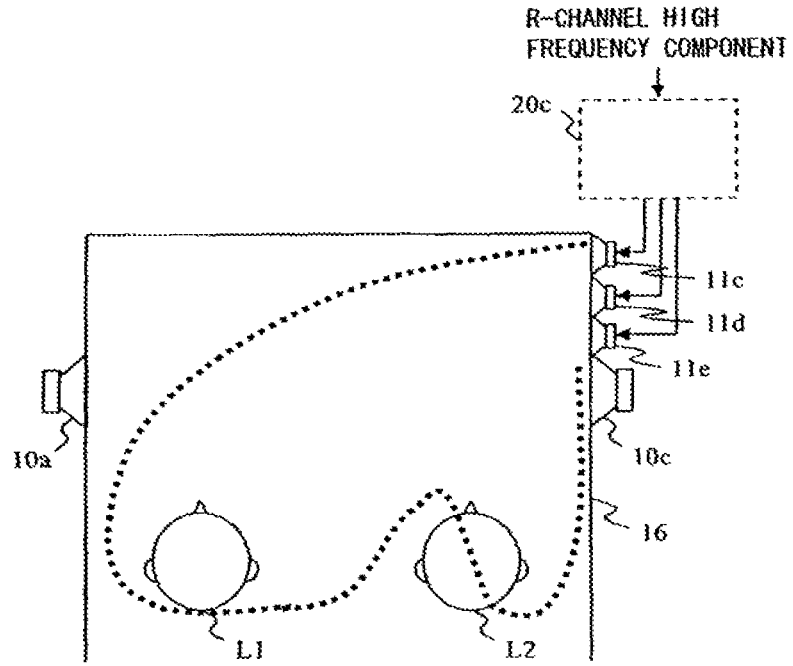
FIG. 22 shows a directivity characteristic of an output component from the first R-channel high frequency signal directivity control means in the vehicle-mountable sound image localization control apparatus for compensating the sound pressure at the left ear of a crew member L2 according to the second embodiment of the present invention.
Figure 23:
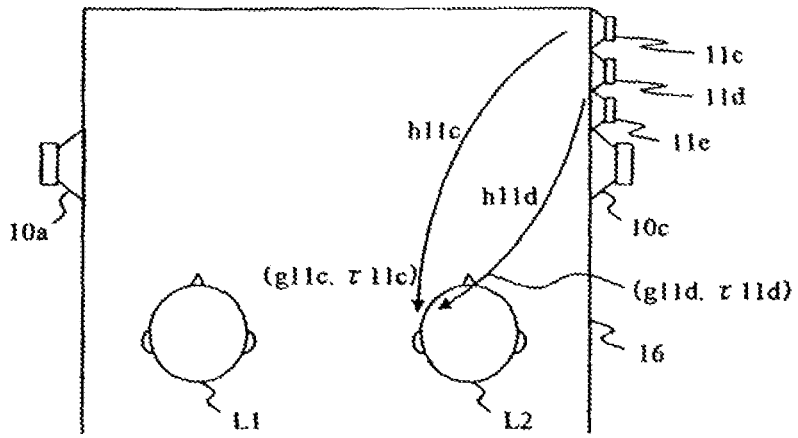
FIG. 23 shows transfer functions from the high frequency reproduction speaker array to the crew member L2 in the vehicle-mountable sound image localization control apparatus according to the second embodiment of the present invention.
Figure 24:
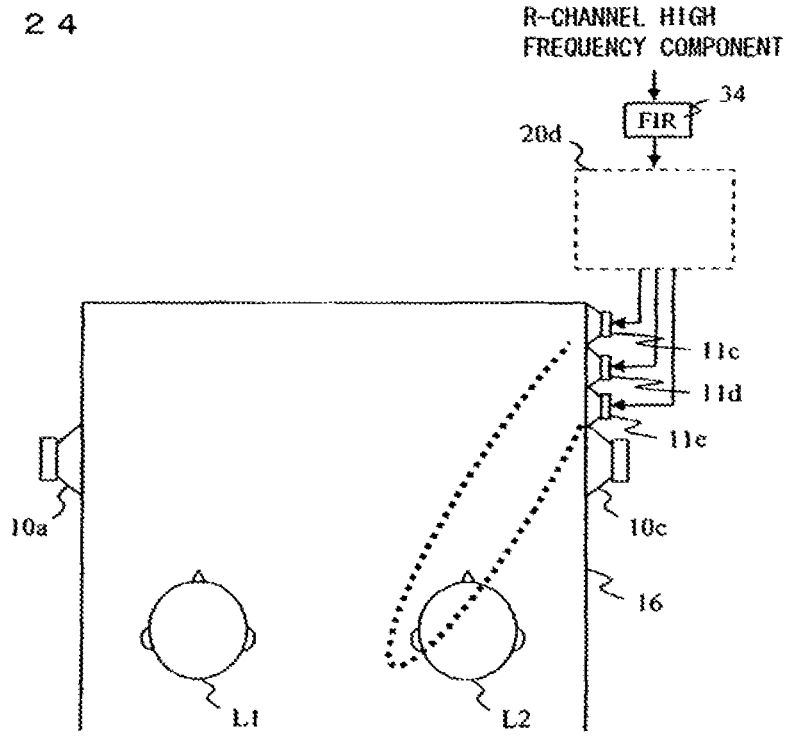
FIG. 24 shows a directivity characteristic of an output component from the second R-channel high frequency signal directivity control means in the vehicle-mountable sound image localization control apparatus for compensating the sound pressure at the left ear of the crew member L2 according to the second embodiment of the present invention.
Figure 25:
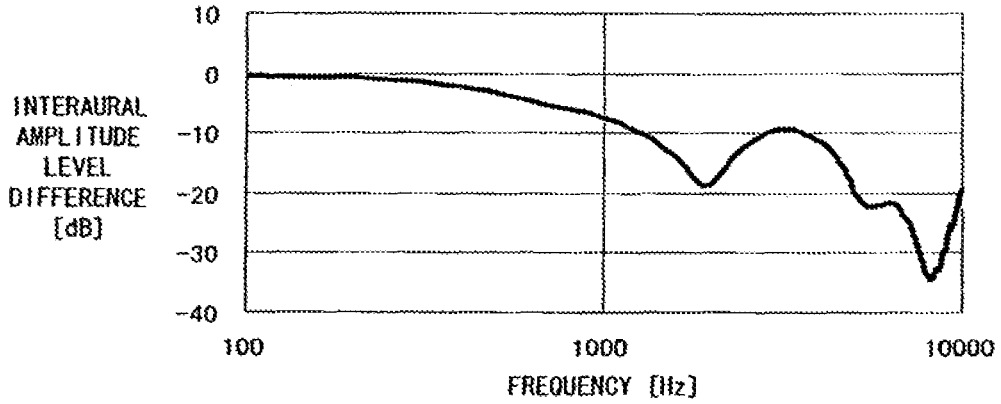
FIG. 25 shows an opposite characteristic of the interaural amplitude level difference of a head-related acoustic transfer function in the direction of 60 degrees.

With the vehicle-mountable sound image localization control apparatus according to the second embodiment shown in FIG. 18, the frequency characteristic of the sound reaching the right ear of the crew member L2 is compensated so that the interaural amplitude level difference has a desired value. Alternatively, the frequency characteristic of the sound reaching the left ear of the crew member L2 may be compensated so that the interaural amplitude level difference has a desired value. In this case, the coefficients of the delay devices 14*a* through 14*f* and the gain devices 15*a* through 15*f* included in the first R-channel high frequency signal directivity control means 20*c* and the second R-channel high frequency signal directivity control means 20*d*, and the FIR filter 34 can be varied. Regarding the first R-channel high frequency signal directivity control means 20*c*, as shown in FIG. 22, the delay devices 14*a* through 14*c* and the gain devices 15*a* through 15*c* can be set such that an output from the first R-channel high frequency signal directivity control means 20*c* has a dead angle in the vicinity of the left ear of the crew member L2. For example, a method for setting a coefficient for making a dead angle by the speakers 11*c* and 11*d* of the high frequency reproduction speaker reproduction array will be described with reference to FIG. 23. The transfer function from the speaker 11*c* to the left ear of the crew member L2 is h11*c*, the sound pressure level at the position of the left ear of the crew member L2 when a predetermined signal is reproduced is g11*c*, and the time required for a signal to reach the left ear of the crew member L2 from the speaker 11*c* is τ11*c*. Similarly, regarding the speaker 11*d* of the high frequency reproduction speaker array, the transfer function is h11*d*, the sound pressure level at the position of the left ear of the crew member L2 is gild, and the required time is τ11*d*. In order to erase the reproduction sound from the speaker 11*c* with the reproduction sound from the speaker 11*d*, −g11*c*/g11*d* is set for the gain device 15*b* for processing the signal to be input to the speaker 11*d*, and τ11*c*-τ11*d* is set for the delay device 14*b* also for processing the signal to be input to the speaker 11*d*. In this manner, a high frequency reproduction speaker array can include a combination of a speaker for reproducing an R-channel high frequency component and a speaker for erasing the reproduction sound at the left ear of the crew member L2. In the case where the high frequency reproduction speaker array includes an odd number of speaker units, a gain of 0 is set for the remaining one speaker so that no sound is output therefrom. Regarding the second R-channel high frequency signal directivity control means 20*d*, as shown in FIG. 24, the delay devices 14*d* through 14*f* and the gain devices 15*d* through 15*f* are set such that an output from the second R-channel high frequency signal directivity control means 20*d* has a directivity characteristic only in the direction generally toward the left ear of the crew member L2. With the vehicle-mountable sound image localization control apparatus described above with reference to FIG. 18, the FIR filter 34 is provided with a coefficient so as to have an interaural amplitude level difference of the head-related acoustic transfer function in the direction of 60 degrees. In a structure for compensating the sound pressure at the left ear of the crew member L2, it is clear that the compensation can be made with the opposite characteristic to the above. FIG. 25 shows a characteristic obtained by multiplying −1 by the interaural amplitude level difference (represented with decibel) of the head-related acoustic transfer function in the direction of 60 degrees (i.e., the difference obtained by subtracting the characteristic at the ear at which the amplitude level is higher from the characteristic at the ear at which the amplitude level is lower). The crew member L2 perceives localization of a sound image in the direction of +60 degrees in the case where a coefficient for realizing the characteristic shown in FIG. 25 is set for the FIR filter 34 and an R-channel high frequency component which is not processed by the FIR filter 34 as shown FIG. 22 is supplied to the left ear of the crew member L2.

Figure 26:
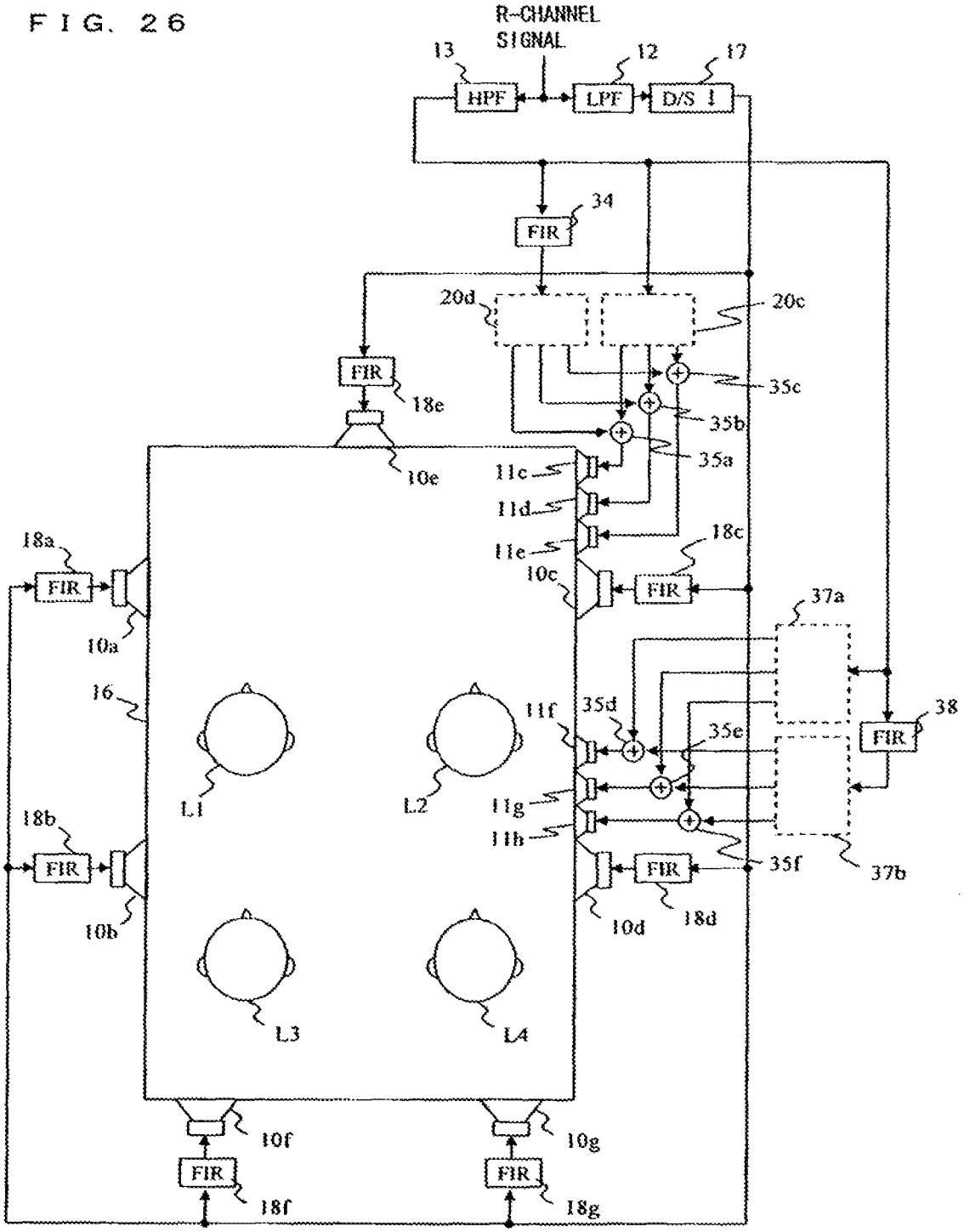
FIG. 26 shows a structure for executing sound image localization control on an R-channel high frequency component for the crew members in the front seats and the crew members in the rear seats at the same time in the vehicle-mountable sound image localization control apparatus according to the second embodiment of the present invention.
Figure 27:
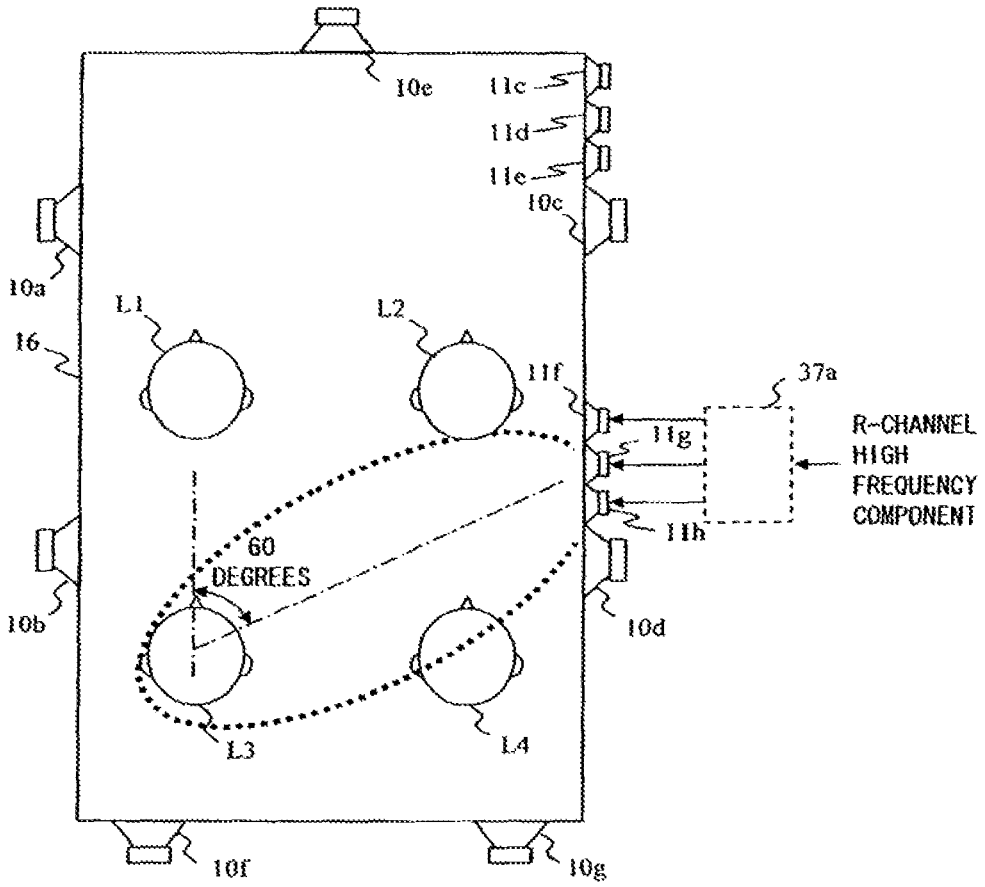
FIG. 27 shows a directivity characteristic of an output component from rear seat first R-channel high frequency signal directivity control means in the vehicle-mountable sound image localization control apparatus according to the second embodiment of the present invention.
Figure 28:
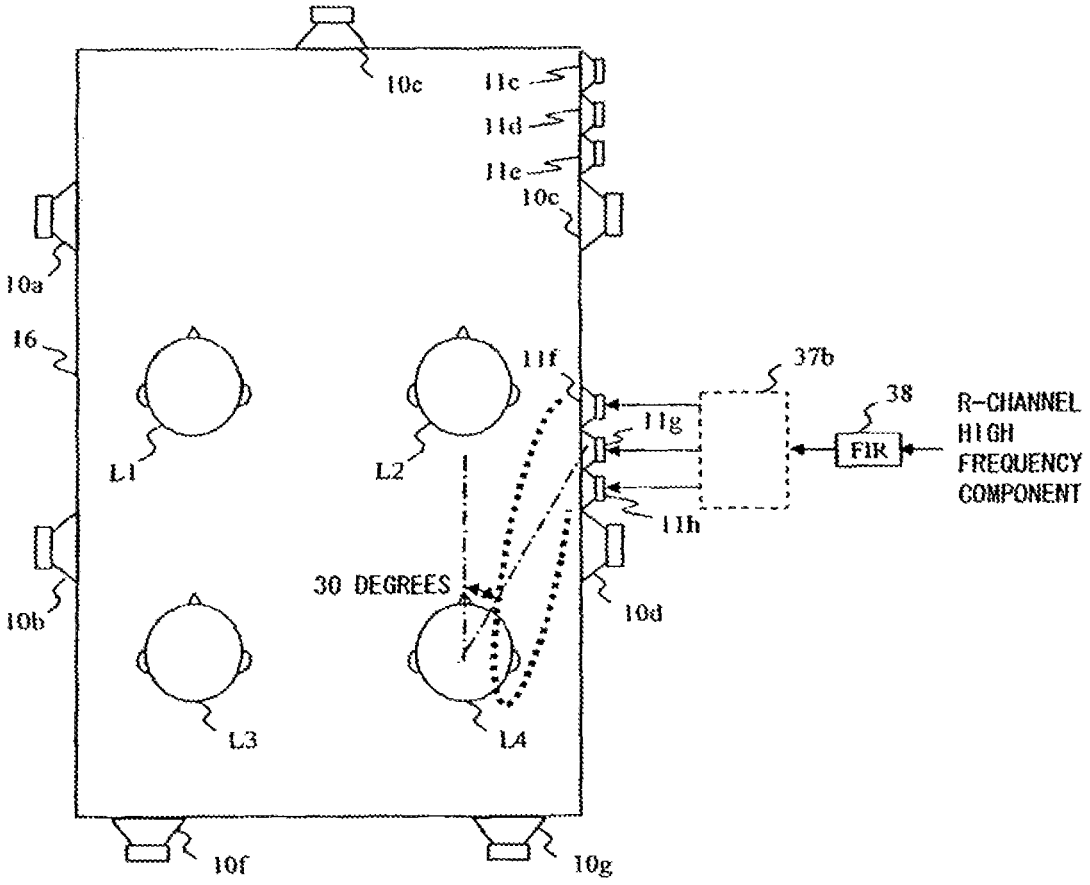
FIG. 28 shows a directivity characteristic of an output component from rear seat second R-channel high frequency signal directivity control means in the vehicle-mountable sound image localization control apparatus according to the second embodiment of the present invention.

Similarly to the first embodiment, the vehicle-mountable sound image control apparatus shown in FIG. 18 has a structure for allowing crew members located in front seats to perceive localization of a sound image in a desired direction. For allowing crew members located in rear seats to perceive localization of a sound image in a desired direction, the following structure can be used. As shown in FIG. 26, a high frequency reproduction speaker array (speakers 11*f* through 11*h*) is attached to a rear door pillar, so that the crew members L1 and L2 located in the front seats and crew members L3 and L4 located in the rear seats can perceive localization of a sound image in a desired direction at the same time. In FIG. 26, reference numerals 11*f* through 11*h* represent the speakers of the high frequency reproduction speaker array attached to the rear door pillar; reference numeral 37*a* represents rear seat first R-channel high frequency signal directivity control means including delay devices and gain devices; reference numeral 38 represents a linear phase FIR filter for processing an R-channel high frequency component; reference numeral 37*b* represents rear seat second R-channel high frequency signal directivity control means including delay devices and gain devices for processing an output from the FIR filter 38; and reference numerals 35*d* through 35*f* represent adders for adding an output from the rear seat first R-channel high frequency signal directivity control means 37*a* and an output from the rear seat second R-channel high frequency signal directivity control means 37*b* and respectively inputting the addition result to the speakers 11*f* through 11*h* of the high frequency reproduction speaker array. The other elements shown in FIG. 26 operate in an identical manner to those shown in FIG. 18 and FIG. 15 and bear identical reference numerals thereto. The localization control operation regarding the crew members L1 and L2 in the front seats is as described above with reference to FIG. 18. The localization control operation on a low frequency component of the R-channel signal regarding the crew members L3 and L4 in the rear seats is as described above with reference to FIG. 15 and will be omitted here. FIG. 27 shows a directivity characteristic of an output from the rear seat first R-channel high frequency signal directivity control means 37*a*. In the rear seat first R-channel high frequency signal directivity control means 37*a*, the delay devices and the gain devices are set such that an output from the high frequency reproduction speaker array (speakers 11*f* through 11*h*) has a high radiation level in the direction toward the crew member L3, i.e., in the direction of 30 degrees on the left and thus the sound reaching the right ear of the crew member L4 is of a very low level and almost inaudible. FIG. 28 shows a directivity characteristic of an output from the rear seat second R-channel high frequency signal directivity control means 37*b*. In the rear seat second R-channel high frequency signal directivity control means 37*b*, the delay devices and the gain devices are set so as to provide a directivity characteristic such that a signal processed by the FIR filter 38 is radiated from the high frequency reproduction speaker array (speakers 11*f* through 11*h*) only to the right ear of the crew member L4 and the vicinity thereof. For the FIR filter 38, a coefficient can be set so as to provide an interaural amplitude level in the direction of 60 degrees described above with reference to FIG. 21 as a characteristic. Since the FIR filter 38 executes the same processing as the FIR filter 34, the FIR filter 38 may be omitted in order to reduce the processing calculation amount. In this case, an output from the FIR filter 34 may be branched and input to the rear seat second R-channel high frequency signal directivity control means 37*b*. With the structure shown in FIG. 26, the crew member L3 listens to an output component from the rear seat first R-channel high frequency signal directivity control means 37*a* among the R-channel high frequency component reproduced from the high frequency reproduction speaker array (speakers 11*f* through 11*h*). Therefore, the crew member L3 perceives localization of an R-channel high frequency component in the direction of +60 degrees where the high frequency reproduction speaker array (speakers 11*f* through 11*h*) exists. The crew member L4 listens to an output component from the rear seat first R-channel high frequency signal directivity control means 37*a* with his/her left ear and listens to an output component from the rear seat second R-channel high frequency signal directivity control means 37*b* with his/her right ear. Therefore, the crew member L4 is given an interaural amplitude level difference in the direction of +60 degrees, and as a result, perceives localization of an R-channel high frequency component in the direction of +60 degrees. The reproduction sound from the high frequency reproduction speaker array (speakers 11*f* through 11*h*) has a directivity characteristic rearward in the vehicle and thus is almost inaudible to the crew members L1 and L2 in the front seats. Therefore, the perception by crew members L1 and L2 of the localization of the R-channel high frequency component by the reproduction sound from the high frequency reproduction speaker array (speakers 11*f* through 11*h*) is not spoiled. The reproduction sound from the high frequency reproduction speaker array (speakers 11*f* through 11*h*) which reaches the rear seats is of a very low level because the sound is attenuated by the distance and the front seats act as an obstacle. Therefore, the perception by the crew members L3 and L4 of the localization of the R-channel high frequency component is not spoiled. Thus, the structure shown in FIG. 26 allows both the crew members L1 and L2 in the front seats and the crew members L3 and L4 in the rear seats to perceive localization of a sound image of the R-channel high frequency component in the direction of +60 degrees at the same time.

Similarly to the first embodiment, the vehicle-mountable sound image localization control apparatus shown in FIG. 18 uses three speaker units 11*c* through 11*e* as the high frequency reproduction speaker array, but the number of the speakers is not limited to three. For improving the acuteness of the directivity characteristic, it is preferable to increase the number of speakers included in the high frequency reproduction speaker array. Needless to say, the number of the delay devices and the number of the gain devices included in the first R-channel high frequency signal directivity control means 20*c* and the second R-channel high frequency signal directivity control means 20*d* are increased or decreased in accordance with the number of the speaker units included in the high frequency reproduction speaker array.

Similarly to the first embodiment, in the vehicle-mountable sound image localization control apparatus shown in FIG. 18, the first R-channel high frequency signal directivity control means 20*c* and the second R-channel high frequency signal directivity control means 20*d* each include delay devices and gain devices, but the present invention is not limited to this structure.

In the first embodiment and the second embodiment, the present invention is applied to a vehicle-mountable sound image localization control apparatus. The present invention is not limited to being used inside a vehicle, and is also applicable to, for example, an environment for viewing and listening contents in a house where the layout of speakers is limited, in order to provide a plurality of users with a superb sound image localization control effect. In a general residence, the space in which speakers can be installed is limited like in the vehicle. Especially front channel speakers are often installed on both sides of a TV. With a technique of adjusting the gain balance and time alignment among the speakers, it is difficult to give a plurality of users superb sound image localization over the entire frequency band.

Figure 29:
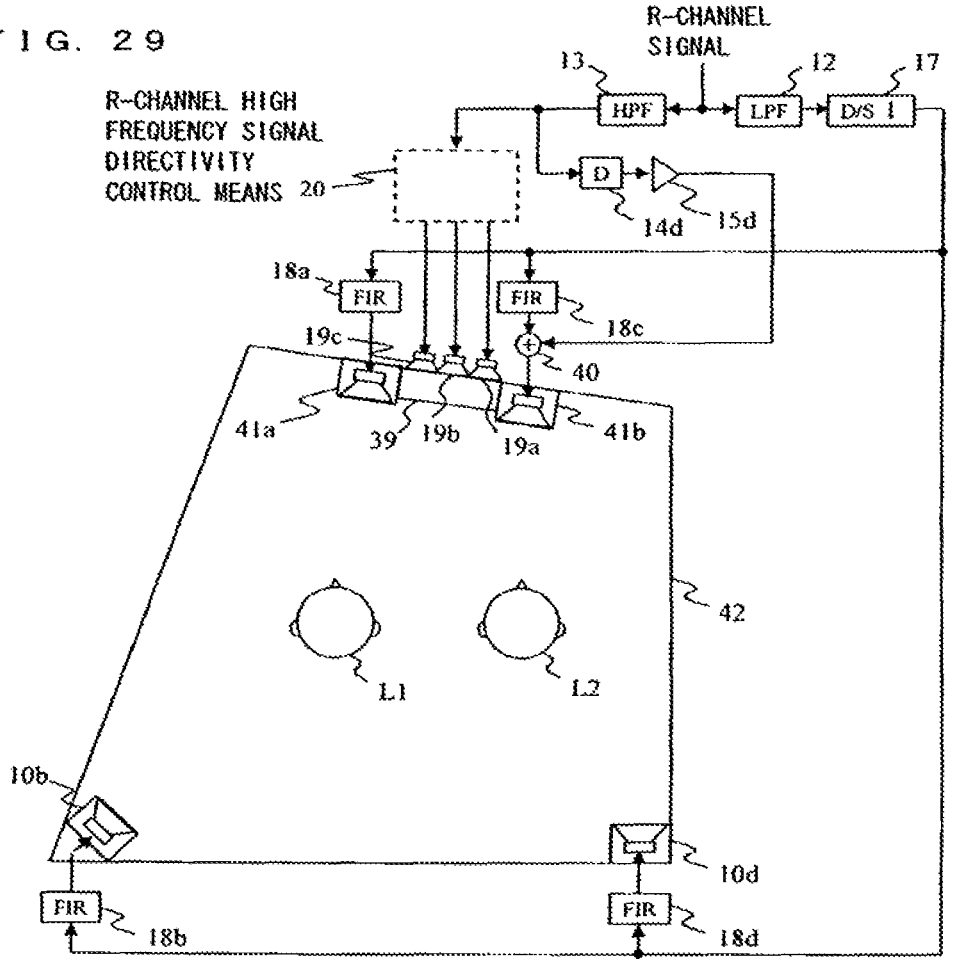
FIG. 29 shows a structure where the vehicle-mountable sound image localization control apparatus according to the first embodiment of the present invention is applied to a home-use content viewing environment.

FIG. 29 shows a structure for providing users L1 and L2 with superb sound image localization of an R-channel signal in a living room 42. The structure has substantially the same structure as that of the vehicle-mountable sound image localization control apparatus described in the first embodiment. Reference numerals 10*b* and 10*d* represent low frequency reproduction speakers, which are installed at both of rear corners in the living room 42. Reference numeral 39 represents a TV installed forward to the users L1 and L2. Reference numerals 41*a* and 41*b* represent full-range reproduction speakers installed on both sides of the TV 39. Reference numerals 19*a* through 19*c* represent speakers of a high frequency reproduction speaker array provided above or below the TV 39. Reference numeral 40 represents an adder for adding an output from the gain device 15*d* and an output from a low frequency localization control FIR filter 18*c* and inputting the addition result to the full-range reproduction speaker 41*b*. The other elements operate in an identical manner to those shown in FIG. 7 and bear identical reference numerals thereto.

Figure 30:
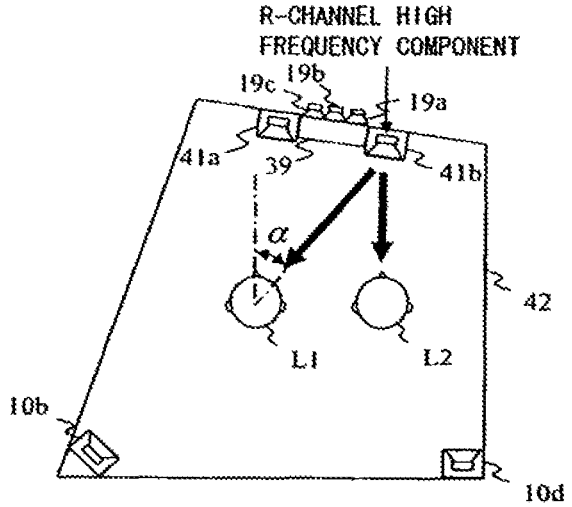
FIG. 30 shows sound image localization directions when only a high frequency reproduction speaker is driven in the structure where the vehicle-mountable sound image localization control apparatus according to the first embodiment of the present invention is applied to the home-use content viewing environment.
Figure 31:
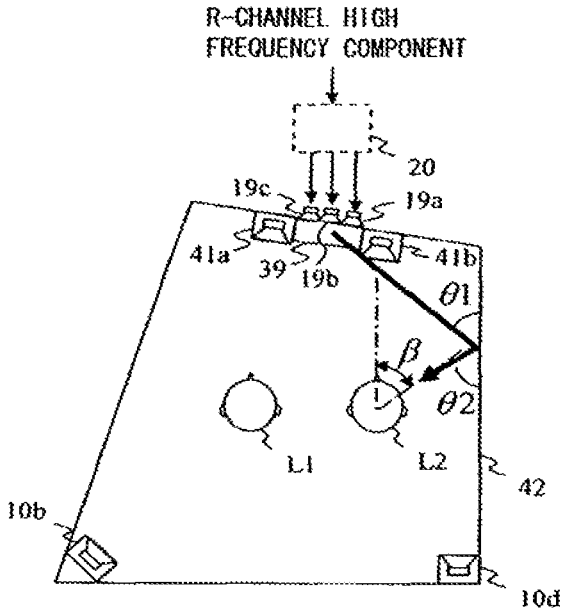
FIG. 31 shows a direction in which a reflected sound comes when only a high frequency reproduction speaker array is driven in the structure where the vehicle-mountable sound image localization control apparatus according to the first embodiment of the present invention is applied to the home-use content viewing environment.
Figure 32:
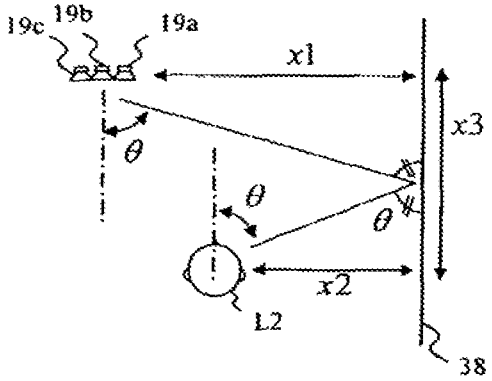
FIG. 32 shows the positional relationship among the high frequency reproduction speaker array, the wall and the user in the structure where the vehicle-mountable sound image localization control apparatus according to the first embodiment of the present invention is applied to the home-use content viewing environment.

Localization control on an R-channel low frequency component is described above with reference to FIG. 7 and will be omitted here. An R-channel high frequency component, with the structure in FIG. 7, is matched in terms of gain and phase with the low frequency component by the delay device 14*d* and the gain device 15*d*, and is reproduced from the high frequency reproduction speaker 11. With the structure shown in FIG. 29, the R-channel high frequency component is matched in terms of gain and phase with the low frequency component by the delay device 14*d* and the gain device 15*d*, then is added with the low frequency component by the adder 40, and is reproduced from the full-range reproduction speaker 41*b*. Therefore, as shown in FIG. 30, the component processed by the delay device 14*d* and the gain device 15*d*, among the R-channel high frequency component, reaches the user L1 from the front right direction of +α degrees and reaches the user L2 from the front direction. As shown in FIG. 31, the delay devices and the gain devices included in the R-channel high frequency signal directivity control means 20 are set such that the sound reproduced from the high frequency reproduction speaker array (speakers 19*a* through 19*c*) is reflected by the wall to the right of the user L2 and reaches the user L2 from the direction of +β degrees. As a result, the high frequency component reproduced from the full-range reproduction speaker 41*b* and the reflected sound from the high frequency reproduction speaker array (speakers 19*a* through 19*c*) are synthesized, and the user L2 perceives localization of a sound image of the R-channel high frequency component in the direction of +β degrees with respect to the front direction. It should be noted that the direction in which a reflected sound of a high level reaches the users is limited by the relationship between the direction of directivity of the output from the high frequency reproduction speaker array (speakers 19*a* through 19*c*) and the position of the wall. As shown in FIG. 32, it is assumed that distance between the high frequency reproduction speaker array (speakers 19*a* through 19*c*) and the wall is x1, the distance between the user L2 and the wall is x2, and the distance between a point at which the high frequency reproduction speaker array (speakers 19*a* through 19*c*) is projected vertically on the wall and a point at which the user L2 is projected vertically on the wall is x3. When the direction of directivity θ of the output from the high frequency reproduction speaker array (speakers 19*a* through 19*c*) fulfills the relationship of x3 tan θ=x1+x2, the user L2 can listen to a reflected sound of a sufficiently high level. When θ1 and θ2 in FIG. 31 are significantly different from each other, the user L2 cannot listen to a reflected sound of a high level. Therefore, it is difficult to allow the user L2 to perceive a sound image of the R-channel high frequency component in a direction close to the direction of +α angle (i.e., the direction in which the user L1 perceives a sound image of the R-channel high frequency component). In the case where the high frequency reproduction speaker array (speakers 19*a* through 19*c*), the wall, and the user L2 are relatively positioned so as to produce a reflected sound such that a synthesized sound of the reflected sound and the reproduction sound from the full-range speaker 41*b* is localized in the direction of α degrees, the delay devices and the gain devices included in the R-channel high frequency signal reproduction directivity control means 20 can be adjusted as necessary in accordance with the direction of the output from the high frequency reproduction speaker array (speakers 19*a* through 19*c*) such that the synthesized sound is localized in the direction of a degrees.

As described above, the structure shown in FIG. 29 allows the users L1 and L2 to perceive localization of an R-channel signal in the same front right direction over the entire frequency band. Needless to say, the localization control on an L-channel signal component can be easily realized as described in the first embodiment.

The vehicle-mountable sound image localization control apparatus described in the second embodiment is applicable to the living room 42, needless to say. In this case, the high frequency reproduction speaker array (speakers 11*c* through 11*e*) described with reference to FIG. 18 is located, for example, above the full-range speaker 41*b*. Then, the delay devices and the gain devices included in the first R-channel high frequency signal directivity control means 20*c* and the second R-channel high frequency signal directivity control means 20*d* are appropriately set such that the high frequency reproduction speaker array (speakers 11*c* through 11*e*) has a desired directivity characteristic.

The vehicle-mountable sound image localization control apparatuses described in the first embodiment and the second embodiment are not limited to being used when the positions of the seats are fixed. For example, when the position of the seat of the crew member L2 shown in FIG. 7 is offset forward from the position according to the original design, the delay time period of the delay devices 14*a* through 14*c* can be set to a value obtained beforehand in accordance with the distance of the offset. Thus, the direction of directivity can be broadened, such that the position at which the reproduction sound from the high frequency reproduction speaker array (speakers 19*a* through 19*c*) is reflected on the glass door to the right of the crew member L2 is offset forward. Needless to say, the distance of the offset may be automatically measured by a sensor or the like and the delay time of the delay devices 14*a* through 14*c* may be calculated based on a predetermined calculation expression and automatically set in accordance with the measurement result.

The head-related acoustic transfer function is significantly varied on an individual basis. Therefore, a plurality of compensation patterns may be prepared so that one compensation pattern is selectable in accordance with the user.

A vehicle-mountable sound image localization control apparatus according to the present invention is usable for obtaining the same level of superb sound image localization, for example, at a plurality of seats in a vehicle.

The invention claimed is:

1. A sound image localization control apparatus to be provided in a vehicle, the sound image localization control apparatus comprising:

a first audio reproduction device configured to generate a first sound wave not having a directivity based on an audio signal;

a second audio reproduction device configured to generate a second sound wave having a directivity by using a plurality of speaker units, based on the audio signal; and a directivity control device configured to process the audio signal to be input to the first and second audio reproduction devices, such that, an interaural amplitude level difference at a first listening position for a first listener is equal to an interaural amplitude level difference at a second listening position for a second listener, by causing the first listener at the first listening position to hear the first sound wave and by causing the second listener at the second listening position to hear a synthesized sound of the first sound wave and the second sound wave, wherein the directivity control device controls the directivity of the second sound wave such that the second sound wave generated by the second audio reproduction device is advanced toward an obstacle located to a side of the second listening position and is reflected by the obstacle so as to reach the second listening position.

2. A sound image localization control apparatus according to claim 1, wherein:

the directivity control device is installed in the vehicle; and the obstacle is a side surface of the vehicle.

3. A sound image localization control apparatus according to claim 2, wherein the first and second audio reproduction devices are installed in a front part in the vehicle.

4. A sound image localization control apparatus according to claim 1, wherein the obstacle is a door glass, the first audio reproduction device is attached to a door pillar in a front part in the vehicle, the second audio reproduction device is attached at a center of a dashboard in the front part in the vehicle, and the directivity control device controls the directivity of the second sound wave such that the second sound wave generated by the second audio reproduction device is radiated toward the door glass located to the side of the second listening position and is reflected by the door glass so as to reach the second listening position.

5. A sound image localization control apparatus comprising:

a first audio reproduction device configured to generate a first sound wave not having a directivity based on an audio signal including an R-channel audio signal;

a second audio reproduction device configured to generate a second sound wave not having a directivity based on an audio signal including an L-channel audio signal;

a third audio reproduction device, located equidistant from the first and second audio reproduction devices, configured to generate a third sound wave having a directivity based on the R-channel audio signal and a fourth sound wave having a directivity based on the L-channel audio signal, respectively; and a directivity control device configured to process the R-channel and L-channel audio signals to be input to the first, second, and third audio reproduction devices, such that an interaural amplitude level difference obtained at a first listening position for a first listener near the second audio reproduction device is equal to an interaural amplitude level difference at a second listening position for a second listener near the first audio reproduction device, by causing the first listener at the first listening position to hear a synthesized sound of the first sound wave and the fourth sound wave, and by causing the second listener at the second listening position to hear a synthesized sound of the second sound wave and the third sound wave.

* * * * *